US008259016B2

(12) United States Patent
Sanz et al.

(10) Patent No.: US 8,259,016 B2
(45) **Date of Patent: *Sep. 4, 2012**

(54) MULTI-BAND MONOPOLE ANTENNA FOR A MOBILE COMMUNICATIONS DEVICE

(75) Inventors: Alfonso Sanz, Barcelona (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 13/029,382

(22) Filed: Feb. 17, 2011

(65) Prior Publication Data

US 2012/0044124 A1 Feb. 23, 2012

Related U.S. Application Data

(63) Continuation of application No. 12/652,974, filed on Jan. 6, 2010, which is a continuation of application No. 12/055,748, filed on Mar. 26, 2008, now Pat. No. 7,675,470, which is a continuation of application No. 11/713,324, filed on Mar. 2, 2007, now Pat. No. 7,403,164, which is a continuation of application No. 11/124,768, filed on May 9, 2005, now Pat. No. 7,411,556, which is a continuation of application No. PCT/EP02/14706, filed on Dec. 22, 2002.

(51) Int. Cl.
*H01Q 1/24* (2006.01)

(52) U.S. Cl. ..... 343/702; 343/700 MS

(58) Field of Classification Search ..... 343/700 MS, 343/702, 895

See application file for complete search history.

(56) References Cited

U.S. PATENT DOCUMENTS

| | | | |
|---|---|---|---|
| 3,079,602 | A | 2/1963 | Du Hamel et al. |
| 3,689,929 | A | 9/1972 | Moody |
| 4,038,662 | A | 7/1977 | Turner |
| 4,123,756 | A | 10/1978 | Nagata et al. |
| 4,318,109 | A | 3/1982 | Weathers |
| 4,356,492 | A | 10/1982 | Kaloi |
| 4,389,651 | A | 6/1983 | Tomasky |
| 4,536,725 | A | 8/1985 | Hübler |
| 4,571,595 | A | 2/1986 | Phillips et al. |
| 4,578,654 | A | 3/1986 | Tait |

(Continued)

FOREIGN PATENT DOCUMENTS

CN 2224466 4/1996

(Continued)

OTHER PUBLICATIONS

Document 415—P.R. 4-3 joint claim construction statement, dated on Jun. 14, 2010.

(Continued)

*Primary Examiner* — Tan Ho
(74) *Attorney, Agent, or Firm* — Winstead PC

(57) ABSTRACT

A multi-band monopole antenna for a mobile communications device includes a common conductor coupled to both a first radiating arm and a second radiating arm. The common conductor includes a feeding port for coupling the antenna to communications circuitry in a mobile communications device. In one embodiment, the first radiating arm includes a space-filling curve. In another embodiment, the first radiating arm includes a meandering section extending from the common conductor in a first direction and a contiguous extended section extending from the meandering section in a second direction.

18 Claims, 7 Drawing Sheets

U.S. PATENT DOCUMENTS 4,608,572 A 8/1986 Blakney et al.
4,827,271 A 5/1989 Berneking et al.
4,843,468 A 6/1989 Drewery
4,860,019 A 8/1989 Jiang et al.
4,907,011 A 3/1990 Kuo
5,014,346 A 5/1991 Phillips et al.
5,075,691 A 12/1991 Garay et al.
5,248,988 A 9/1993 Makino
5,307,075 A 4/1994 Huynh
5,337,065 A 8/1994 Bonnet et al.
5,355,318 A 10/1994 Dionnet et al.
5,363,114 A 11/1994 Shoemaker
5,410,322 A 4/1995 Sonoda
5,453,752 A 9/1995 Wang et al.
5,457,469 A 10/1995 Diamond et al.
5,557,293 A 9/1996 McCoy et al.
5,572,223 A 11/1996 Phillips et al.
5,608,417 A 3/1997 De Vall
5,809,433 A 9/1998 Thompson et al.
5,870,066 A 2/1999 Asakura et al.
5,872,546 A 2/1999 Ihara et al.
5,898,404 A 4/1999 Jou
5,918,183 A 6/1999 Janky et al.
5,926,139 A 7/1999 Korisch
5,929,825 A 7/1999 Niu et al.
5,933,330 A 8/1999 Beutler
5,936,587 A 8/1999 Gudilev et al.
5,943,020 A 8/1999 Liebendoerfer et al.
5,963,871 A 10/1999 Zhinong et al.
5,966,098 A 10/1999 Qi et al.
5,986,609 A 11/1999 Spall
5,986,610 A 11/1999 Miron
5,990,838 A 11/1999 Burns et al.
5,990,849 A 11/1999 Salvail et al.
5,995,052 A 11/1999 Sadler et al.
6,011,518 A 1/2000 Yamagishi et al.
6,011,699 A 1/2000 Murray et al.
6,031,505 A 2/2000 Qi et al.
6,087,990 A 7/2000 Thill et al.
6,094,179 A 7/2000 Davidson
6,097,339 A 8/2000 Filipovic et al.
6,104,349 A 8/2000 Cohen
6,111,545 A 8/2000 Saari
6,112,102 A 8/2000 Zhinong
6,122,533 A 9/2000 Zhang et al.
6,130,651 A 10/2000 Yanagisawa et al.
6,140,966 A 10/2000 Pankinaho
6,140,975 A 10/2000 Cohen
6,141,540 A 10/2000 Richards et al.
6,147,655 A 11/2000 Roesner
6,160,513 A 12/2000 Davidson et al.
6,166,694 A 12/2000 Ying
6,181,281 B1 1/2001 Desclos et al.
6,195,048 B1 2/2001 Chiba et al.
6,198,442 B1 3/2001 Rutkowski et al.
6,201,501 B1 3/2001 Arkko et al.
6,204,826 B1 3/2001 Rutkowski et al.
6,211,826 B1 4/2001 Aoki
6,215,474 B1 4/2001 Shah
6,236,366 B1 5/2001 Yamamoto et al.
6,239,765 B1 5/2001 Johnson et al.
6,243,592 B1 6/2001 Nakada et al.
6,259,407 B1 7/2001 Tran
6,266,023 B1 7/2001 Nagy et al.
6,266,538 B1 7/2001 Waldron
6,271,794 B1 8/2001 Geeraert
6,275,198 B1 8/2001 Kenoun et al.
6,281,846 B1 8/2001 Puente et al.
6,285,327 B1 9/2001 See
6,288,680 B1 9/2001 Tsuru et al.
6,300,914 B1 10/2001 Yang
6,307,511 B1 10/2001 Ying et al.
6,317,084 B1 11/2001 Chen et al.
6,329,951 B1 12/2001 Wen et al.
6,329,962 B2 12/2001 Ying
6,337,663 B1 1/2002 Chi-Ming
6,337,667 B1 1/2002 Ayala et al.
6,343,208 B1 1/2002 Ying
6,352,434 B1 3/2002 Emmert
6,353,443 B1 3/2002 Ying
6,366,243 B1 4/2002 Isohatala et al.
6,384,790 B2 5/2002 Dishart et al.
6,408,190 B1 6/2002 Ying
6,417,816 B2 7/2002 Sadler et al.
6,445,352 B1 9/2002 Cohen
6,452,553 B1 9/2002 Cohen
6,452,556 B1 9/2002 Ha et al.
6,459,413 B1 10/2002 Tseng et al.
6,476,769 B1 11/2002 Lehtola
6,483,462 B2 11/2002 Weinberger
6,549,789 B1 4/2003 Kfoury
6,614,400 B2 9/2003 Egorov
6,664,930 B2 12/2003 Wen et al.
6,674,405 B2 1/2004 Wang
6,693,604 B2 2/2004 Washiro et al.
6,697,022 B2 2/2004 Ponce De Leon et al.
6,741,215 B2 5/2004 Grant et al.
6,762,723 B2 7/2004 Nallo et al.
6,781,548 B2 8/2004 Wen et al.
6,801,164 B2 10/2004 Bit-Babik et al.
6,822,611 B1 11/2004 Kontogeorgakis et al.
6,831,606 B2 12/2004 Sajadinia
6,839,040 B2 1/2005 Huber et al.
6,853,352 B2 2/2005 Nevermann et al.
6,864,854 B2 3/2005 Dai et al.
6,882,320 B2 4/2005 Park et al.
6,950,071 B2 9/2005 Wen et al.
6,963,310 B2 11/2005 Horita et al.
6,995,720 B2 2/2006 Shikata
7,015,868 B2 3/2006 Puente et al.
7,057,560 B2 6/2006 Erkocevic
7,068,230 B2 6/2006 Qi et al.
7,069,043 B2 6/2006 Sawamura et al.
7,081,857 B2 7/2006 Kinnunen et al.
7,095,372 B2 8/2006 Soler et al.
7,123,208 B2 10/2006 Puente et al.
7,126,537 B2 10/2006 Cohen
7,148,850 B2 12/2006 Puente et al.
7,202,822 B2 4/2007 Baliarda et al.
7,289,072 B2 10/2007 Sakurai
7,312,762 B2 12/2007 Puente et al.
7,342,553 B2 3/2008 Soler Castany et al.
7,394,432 B2 7/2008 Baliarda et al.
7,397,431 B2 7/2008 Baliarda et al.
7,403,164 B2 7/2008 Sanz et al.
7,411,556 B2 8/2008 Sanz et al.
7,423,592 B2 9/2008 Pros et al.
7,446,708 B1 11/2008 Nguyen et al.
7,463,199 B2 12/2008 Soler Castany et al.
7,511,675 B2 3/2009 Puente-Baliarda et al.
7,528,782 B2 5/2009 Baliarda et al.
7,675,470 B2 3/2010 Sanz et al.
2001/0002823 A1 6/2001 Ying
2001/0044320 A1 11/2001 Ono et al.
2001/0050636 A1 12/2001 Weinberg
2001/0050637 A1 12/2001 Aoyama et al.
2002/0000940 A1 1/2002 Moren et al.
2002/0044090 A1 4/2002 Bahr et al.
2002/0080088 A1 6/2002 Boyle
2002/0140615 A1 10/2002 Carles et al.
2002/0149527 A1 10/2002 Wen et al.
2002/0175866 A1 11/2002 Gram
2002/0190904 A1 12/2002 Cohen
2003/0137459 A1 7/2003 Kim et al.
2003/0184482 A1 10/2003 Bettin et al.
2003/0210187 A1 11/2003 Wong et al.
2004/0004574 A1 1/2004 Wen et al.
2004/0009755 A1 1/2004 Yoshida
2004/0027295 A1 2/2004 Huber et al.
2004/0090372 A1 5/2004 Nallo et al.
2004/0095289 A1 5/2004 Bae et al.
2004/0106428 A1* 6/2004 Shoji ..... 455/550.1
2004/0140938 A1 7/2004 Kadambi et al.
2004/0203529 A1* 10/2004 Hong et al. ..... 455/90.3
2004/0212545 A1 10/2004 Li et al.
2005/0237244 A1 10/2005 Annabi et al.
2005/0239519 A1* 10/2005 Saitou et al. ..... 455/575.1

| | | | |
|---|---|---|---|
| 2005/0259031 | A1 | 11/2005 | Sanz et al. |
| 2006/0028380 | A1 | 2/2006 | Harano |
| 2006/0033668 | A1 | 2/2006 | Ryu |
| 2006/0170610 | A1 | 8/2006 | Rabinovich et al. |
| 2007/0024508 | A1 | 2/2007 | Lee |
| 2007/0046548 | A1 | 3/2007 | Pros et al. |
| 2007/0103371 | A1 | 5/2007 | Kim et al. |
| 2007/0152887 | A1 | 7/2007 | Castany et al. |
| 2007/0152894 | A1 | 7/2007 | Sanz et al. |
| 2007/0152984 | A1 | 7/2007 | Ording et al. |
| 2007/0194997 | A1 | 8/2007 | Nakanishi et al. |
| 2009/0109101 | A1 | 4/2009 | Baliarda et al. |

FOREIGN PATENT DOCUMENTS

| | | |
|---|---|---|
| EP | 0749176 | 6/1996 |
| EP | 0766343 | 9/1996 |
| EP | 0777293 | 6/1997 |
| EP | 0590671 | 12/1997 |
| EP | 0884796 | 3/1999 |
| EP | 0902472 | 3/1999 |
| EP | 0938158 | 8/1999 |
| EP | 0969375 | 1/2000 |
| EP | 0986130 | 3/2000 |
| EP | 1011167 | 6/2000 |
| EP | 1091445 | 4/2001 |
| EP | 1198027 | 4/2002 |
| EP | 1237224 | 9/2002 |
| EP | 1367671 | 12/2003 |
| EP | 1258054 | 8/2005 |
| ES | 2112163 | 3/1998 |
| ES | 2142280 | 5/2000 |
| GB | 2317994 | 4/1998 |
| GB | 2361584 | 10/2001 |
| JP | 62-262502 | 11/1987 |
| JP | 05007109 | 1/1993 |
| JP | 5-308223 | 11/1993 |
| JP | 06-085530 | 3/1994 |
| JP | 6252629 | 9/1994 |
| JP | 1997-246852 | 9/1997 |
| JP | 10-117108 | 5/1998 |
| JP | 10-163748 | 6/1998 |
| JP | 10-200327 | 7/1998 |
| JP | 10247808 | 9/1998 |
| JP | 10-303637 | 11/1998 |
| JP | 11-004113 | 1/1999 |
| JP | 11-027042 | 1/1999 |
| JP | 11136015 | 5/1999 |
| JP | 11-220319 | 8/1999 |
| JP | 2001217632 | 8/2001 |
| JP | 2001-251128 | 9/2001 |
| JP | 2001-332924 | 11/2001 |
| JP | 2002050919 | 2/2002 |
| JP | 2003-347835 | 12/2003 |
| WO | 96/29755 | 9/1996 |
| WO | 96/38881 | 12/1996 |
| WO | 97/06578 | 2/1997 |
| WO | 97/35360 | 9/1997 |
| WO | 98/05088 | 2/1998 |
| WO | 98/20578 | 5/1998 |
| WO | 88/09065 | 11/1998 |
| WO | 99/03166 | 1/1999 |
| WO | 99/27608 | 6/1999 |
| WO | 99/56345 | 11/1999 |
| WO | 99/65102 | 12/1999 |
| WO | 99/67851 | 12/1999 |
| WO | 00/03451 | 1/2000 |
| WO | 00/36700 | 6/2000 |
| WO | 00/77884 | 12/2000 |
| WO | 01/08257 | 2/2001 |
| WO | 01/11721 | 2/2001 |
| WO | 01/17063 | 3/2001 |
| WO | 01/22528 | 3/2001 |
| WO | 01/26182 | 4/2001 |
| WO | 01/33665 | 5/2001 |
| WO | 0131747 | 5/2001 |
| WO | 01/48861 | 7/2001 |
| WO | 01/54225 | 7/2001 |
| WO | 01/56111 | 8/2001 |
| WO | 02/35646 | 5/2002 |
| WO | 02/35652 | 5/2002 |
| WO | 02/078123 | 10/2002 |
| WO | 03/034538 | 4/2003 |
| WO | 03/034544 | 4/2003 |
| WO | 2004/001894 | 12/2003 |
| WO | 2004/025778 | 3/2004 |
| WO | 2004/042868 | 5/2004 |
| WO | 2004/057701 | 7/2004 |
| WO | 2005/076409 | 8/2005 |

OTHER PUBLICATIONS

Document 429—Declaration of Jeffery D. Baxter—Including Exhibits: J, K, L, M ,N ,O, P, Q, R, S, T, U, Z, AA, KK, LL, dated on Jul. 30, 2010.

Document 452—Defendant's reply in support of their motion for summary judgment of invalidity based on indefiniteness and lack of written description for certain terms with exhibits WW, BBB, EEE, GGG, HHH, III, KKK, MMM, NNN, OOO, PPP, Q, dated on Aug. 30, 2010.

Document 641—Defendant HTC America, Inc's second amended answer and counterclaim to plaintiffs second amended complaint, dated on Feb. 25, 2011.

Document 642—Defendant HTC Corporation's second amended answer and counterclaim to plaintiffs second amended complaint, dated on Feb. 25, 2011.

Document 889—Reply in support of defendants' motion to clarify claim construction, dated on Apr. 27, 2011.

Document 893—Fractus SA's surreply to defendant's motion to clarify claim construction, Apr. 29, 2011.

Document 900—Order, dated on Apr. 29, 2011.

Document 901—Report and recommendation of United States Magistrate Judge, dated on May 2, 2011.

Document 902—Fractus SA's objections to defendants' prior art notice, dated on May 2, 2011.

Document 915—Defendants' response to plaintiffs objections to defendants notice of prior art, dated on May 5, 2011.

Document 933—Defendants' motion for reconsideration of, and objections to, the May 2, 2011 report and recommendation clarifying claim construction, dated on May 9, 2011.

Document 939—Fractus's response to defendants' motion for reconsideration of and objections to the May 2, 2011, report and recommendations clarifying claim construction, dated on May 10, 2011.

Document 968—Order, dated on May 13, 2011.

Document 971—Order, dated on May 13, 2011.

Andersen, J. B., The handbook of antenna design—Low- and medium-gain microwave antennas, Rudge , A. W. et al—IEE Eletromagnetic Waves Series; Peter Peregrinus Ltd. (2nd ed.), vols. 1 and 2, 1986, pp. 526-543.

Internal Photos—FCC ID: GMLNPW-3 , FCC , Dec. 19, 2001.

US95/001462 , US95/000590—Patent owners response to Action Closing Prosecution for US patent 7411556, dated on Jan. 17, 2012.

95/0001462 , 95/000590—Third party requesters comments to patent owners reply of Jan. 7, 2012 for US patent 7411556, dated on Feb. 16, 2012.

95/001462 , 95/000590—Right of Appeal Notice for US patent 7411556, dated on Mar. 12, 2012.

The oral and videotaped deposition of Dwight Jaggard. vol. 1, dated on Mar. 8, 2011.

The oral and videotaped deposition of Dwight Jaggard. vol. 2, dated on Mar. 9, 2011.

The oral and videotaped deposition of Dwight Jaggard. vol. 3, dated on Mar. 10, 2011.

Transcript of pretrial hearing before the Honorable Leonard Davis, US District Judge—2:00 PM—dated on May 16, 2011.

Transcript of jury trial before the Honorable Leonard Davis US District Judge—8:00 AM—dated on May 17, 2011.

Transcript of jury trial before the Honorable Leonard Davis, US District Judge—1:10 PM—dated on May 17, 2011.

Transcript of jury trial before the Honorable Leonard Davis—1:00 PM—dated on May 18, 2011.

Transcript of jury trial before the Honorable Leonard Davis—8:45 AM—dated on May 18, 2011.

Transcript of jury trial before the Honorable Leonard Davis—8:30 AM—dated on May 20, 2011.
Transcript of jury trial before the Honorable Leonard Davis—1:00 PM—dated on May 19, 2011.
Transcript of jury trial before the Honorable Leonard Davis—8:45 AM—dated on May 19, 2011.
Transcript of jury trial before the Honorable Leonard Davis—12:30 PM—dated on May 20, 2011.
Transcript of jury trial before the Honorable Leonard Davis—8:55 AM—dated on May 23, 2011.
Demonstratives presented by Dr. Stuart Long during trial, dated on May 18, 2011.
Demonstratives presented by Dr. Steven Best during trial, dated on May 19, 2011.
Campos , O., Multiband and miniature fractal antennas study : Estudi d'antenes fractal multibanda i en miniatura, Universitat Politecnica de Catalunya , 1998.
Verdura , O., Miniature fractal antenna : Antena fractal miniatura, Universitat Politecnica de Catalunya , Sep. 1997.
Borja , C., Fractal microstrip antennas : Antenas fractales microstrip, Universitat Poltecnica de Catalunya, Jul. 1997.
Oral and videotaped deposition of Dr. Stuart Long—vol. 1, dated on Mar. 11, 2011.
Oral and videotaped deposition of Dr. Stuart Long—vol. 2, dated on Mar. 13, 2011.
Oral and videotaped deposition of Dr. Stuart Long—vol. 3, dated on Mar. 14, 2011.
Oral and videotaped deposition of Dr. Warren L. Stutzman—vol. 1, dated on Mar. 3, 2011.
Oral and videotaped deposition of Dr. Warren L. Stutzman—vol. 2, dated on Mar. 4, 2011.
Document 1082—Joint motion to dismiss HTC, dated on Sep. 13, 2011.
Document 1083—Order—Final consent judgement HTC, dated on Sep. 15, 2011.
Document 1088—Samsung's motion to determine intervening rights in view of new Federal Circuit case law or, in the alternative, to stay the case pending the outcome of reexamination, dated on Oct. 19, 2011.
Document 10919—Fractus's response to Samsung's motion to determine intervening rights or to stay the case pending the outcome of reexamination, dated on Nov. 2, 2011.
Document 1092—Samsung's reply in support of its motion to determine intervening rights in view of new Federal Circuit case law or, in the alternative, to stay the case pending the outcome of reexamination, dated on Nov. 14, 2011.
Action dosing prosecution for US patent 7411556—95/000590 , 95/001462, dated on Dec. 14, 2011.
Besthorn 1.0 to 21.0 GHz Log-periodic dipole antenna Symposium on the USAF Antenna Research and Development Program, 18th Oct. 15, 1968.
Ishikawa , Y. ; Hattori , J. ; Andoh , M. et al. 800 MHz High Power Bandpass Filter Using TM Dual Mode Dielectric Resonators European Microwave Conference , 21th Sep. 9, 1991.
Greiser , J. W. and Brown , G. S. A 500:1 scale model of warla : A wide aperture radio location array Symposium on the USAF Antenna Research and Development Program, 13th Oct. 14, 1963.
Larson , J. A BAW Antenna Duplexer for the 1900 MHz PCS Band IEEE Ultrasonics Symposium Oct. 17, 1999.
Rowell , C. R. ; Murch , R.D. A capacitively loaded PIFA for compact mobile telephone handsets Antennas and Propagation, IEEE Transactions on May 1, 1997.
Chen , M.H. A compact EHF/SHF dual frequency antenna IEEE International Symposium on Antennas and Propagation May 7, 1990.
Hofer , D. A. ; Kesler , Dr. O. B. ; Loyet , L. L. A compact multipolarized broadband antenna Proceedings of the 1989 antenna applications symposium Sep. 20, 1989.
Rowell , Corbett R. ; Murch , R. D. A compact PIFA suitable for dual-frequency 900-1800-MHz operation Antennas and Propagation, IEEE Transactions on Apr. 1, 1998.
Kuhlman , E. A. A directional flush mounted UHF communications antenna for high performance jet aircraft for the 225-400 MC frequency range Symposium on the USAF Antenna Research and Development Program, 5th Oct. 1, 1955.
Halloran , T. W. A dual channel VHF telemetry antenna system for re-entry vehicle applications Symposium on the USAF Antenna Research and Development Program, 11th Oct. 16, 1961.
Holtum , A. G. A dual frequency dual polarized microwave antenna Symposium on the USAF Antenna Research and Development Program, 16 Oct. 11, 1966.
Boshoff , H. A fast box counting algorithm for determining the fractal dimension of sampled continuous functions IEEE Jan. 1, 1992.
Sandlin , B. ; Terzouli , A. J. A genetic antenna desig for improved radiation over earth Antenna Applications Symposium , Program for 1997—Allerton Conference Proceedings Sep. 17, 1997.
Barrick , W. A helical resonator antenna diplexer Symposium on the USAF antenna research and development program, 10th Oct. 3, 1960.
Brown, A. A high-performance integrated K-band diplexer Transactions on Microwave Theory and Techniques Aug. 8, 1999.
Nagai , K. ; Mikuni , Y. ; Iwasaki , H. A mobile radio antenna system having a self-diplexing function IEEE Transactions on Vehicular Technology Nov. 1, 1979.
Kyriacos , S. ; Buczkowski , S. et al. A modified box-counting method Fractals—World Scientific Publishing Company Jan. 1, 1994.
Liu , D. A multi-branch monopole antenna for dual-band cellular applications IEEE Antennas and Propagation Society International Symposium Sep. 3, 1999.
Omar, Amjad A. ; Antar , Y. M. M. A new broad band dual frequency coplanar waveguide fed slot antenna Antennas and Propagation Society International Symposium, 1999. IEEE Jul. 11, 1999.
Fenwick , R. C. A new class of electrically small antennas Antennas and Propagation, IEEE Transactions on May 1, 1965.
Sawaya , K. ; Ishizone , T. ; Mushiake , Y. A simplified Expression of Dyadic Green's Function for a Conduction Half Sheet vol. AP-29, No. 5 (Sep. 1981) IEEE Transactions on Antennas & Propagation Sep. 1, 1981.
Bokhari , S. A. ; Zürcher , J.-F. ; Mosig , Juan R. et al A small microstrip patch antenna with a convenient tuning option Antennas and Propagation, IEEE Transactions on Nov. 1, 1996.
Ferris , J. E. A status report of an Azimuth and elevation direction finder Symposium on the USAF Antenna Research and Development Program Oct. 15, 1968.
Deng , Sheng-Ming a t-strip loaded rectangular microstrip patch antenna for dual-frequency operation Antennas and Propagation Society International Symposium, 1999. IEEE Jul. 1, 1999.
Ali , M. ; Hayes , G. J. et al A triple band internal antenna for mobile handheld terminals Antennas and Propagation Society International Symposium, 2002. IEEE Jun. 16, 2002.
Teeter , W. L. ; Bushore , K. R. A variable-ratio microwave power divider and multiplexer IRE Transactions on microwave theory and techniques Oct. 1, 1957.
Shimoda , R. Y. A variable impedance ratio printed circuit balun Antenna Applications Symposium Sep. 26, 1979.
Phelan , R. A wide-band parallel-connected balun Microwave Theory and Techniques, IEEE Transactions on May 1, 1970.
Rosa , J. ; Case E. W. A wide angle circularly polarized omnidirectional array antenna Symposium on the USAF antenna Research and Development Program , 18th Oct. 15, 1968.
Foroutan-pour , K. ; Dutilleul , P. ; Smith , D.L. Advances in the implementation of the box-counting method of fractal dimension estimation Applied Mathematics and Computation ; Elsevier May 1, 1999.
Wimer , Michael C. Advisory Action before the filing of an Appeal Brief for U.S. Appl. No. 10/422,578 USPTO Jun. 23, 2005.
May , M. Aerial magic New Scientist Jan. 31, 1998.
Ellis , A. R. Airborne UHF antenna pattern improvements Symposium on the USAF antenna research and development program, 3rd Oct. 18, 1953.
NA Amended answer of the Sharp defendants to plaintiffs second amended complaint Defendants Feb. 24, 2010.
NA Amended complaint for patent infringement—Case 6:09-cv-00203 Fractus May 6, 2009.
Sauer , J. Amendment and response to office action dated Dec. 13, 2004 of U.S. Appl. No. 10/182,635 Jones Day Mar. 17, 2005.

Sauer , J. Amendment and response to office action dated Oct. 4, 2004 of U.S. Appl. No. 10/182,635 Jones Day Nov. 12, 2004.
Maiorana , D. Amendment and response to the Office Action dated on Jan. 23, 2004 of U.S. Appl. No. 10/102,568 Jones Day May 16, 2004.
Mithani , S. Amendment in response to non-final office action dated Aug. 23, 2006 of U.S. Appl. No. 11/124,768 Jenkens & Gilchrist Nov. 13, 2006.
Mithani , S. Amendment in response to non-final office action dated Feb. 6, 2008 of U.S. Appl. No. 11/713,324 Winstead PC Mar. 17, 2008.
Mithani , S. Amendment in response to non-final office action dated Oct. 1, 2008 of U.S. Appl. No. 12/055,748 Winstead PC Mar. 2, 2009.
Mithani , S. Amendment in response to non-final office action dated on Dec. 28, 2007 of U.S. Appl. No. 11/124,768 Winstead PC Feb. 1, 2008.
Mithani , S. Amendment in response to the office action dated Feb. 21, 2007 for U.S. Appl. No. 11/124,768 Winstead PC Jun. 7, 2007.
NA American Heritage College Dictionary (1997). Pags 340 and 1016 Mifflin Comp. Case 6:09-cv-00203-LED-JDL Jan. 1, 1997.
NA American Heritage Dictionary of the English Language Houghton Mifflin Company Jan. 1, 2000.
Ou , J. D. An analysis of annular, annular sector, and circular sector microstrip antennas Antenna Applications Symposium Sep. 23, 1981.
Sarkar , N. An efficient differential box-counting approach to compute fractal dimension of image IEEEn Transactions on System, Man and Cybernetics Jan. 3, 1994.
Hill , J. E. ; Bass , J. F. An integrated strip-transmission-line antenna system for J-band Symposium on the USAF Antenna Research and Development Program, 23th Oct. 10, 1973.
Sim , D. An internal triple-band antenna for PCS/IMT-2000/ Bluetooth applications Antennas and Wireless Propagation Letters, IEEE Jan. 1, 2004.
Martin , R. W. ; Stangel, J. J. An unfurlable, high-gain log-periodic antenna for space use Symposium on the USAF Antenna Research and Development Program Nov. 14, 1967.
Sanchez Hernandez , David et al Analysis and design of a dual-band circularly polarized microstrip patch antenna Antennas and Propagation, IEEE Transactions on Feb. 1, 1995.
Pozar , D. ; Newman , E. Analysis of a Monopole Mounted near or at the Edge of a Half-Plane IEEE Transactions on Antennas and Propagation May 1, 1981.
Lee, J. C. Analysis of differential line lenght diplexers and long-stub filters Symposium on the USAF Antenna Research and Development, 23th Oct. 12, 1971.
Shnitkin , H. Analysis of log-periodic folded dipole array Antenna Applications Symposium Sep. 10, 1992.
NA Answer of the Sharp Defendants to plaintiffs second amended complaint Defendants Dec. 29, 2009.
NA Answer, affirmative defenses and counterclaims to the amended complaint for patent infringement on behalf of Defendant Personal Communications Devices Holdings, LLC Defendants Jul. 20, 2009.
NA Answer, affirmative defenses and counterclaims to the second amended complaint for patent infringement on behalf of Defendant Personal Communications Devices Holdings, LLC Defendants Dec. 17, 2009.
Borja , C. Antenas fractales microstrip Universitat Politecnica de Catalunya Jul. 1, 1997.
Locus , Stanley S. Antenna design for high performance missile environment Symposium on the USAF Antenna Research and Development Program, 5th Oct. 16, 1955.
Weeks , W. L. Antenna engineering McGraw-Hill Book Company Jan. 1, 1968.
Tai , Chen to ; Long , Stuart. Antenna engineering handbook—Chapter 4—Dipoles and Monopoles Johnson , R. Mc Graw Hill—(3rd Ed.) Jan. 1, 1993.
DuHamel , R. H. ; Scherer , J. P. Antenna engineering handbook—Chapter 14—Frequency-Independent Antennas Johnson , R. McGraw-Hill (3rd. edition) Jan. 1, 1993.
Nagy , L. L Antenna engineering handbook—Chapter 39—Automobile antennas Volakis , J.—McGraw-Hill; 4th edition Jan. 1, 2007.
Johnson , R. C. Antenna engineering handbook—Table of contents McGraw-Hill Jan. 1, 1993.
Burnett , G. F. Antenna installations on super constellation airbone early warning and control aircraft Symposium on the USAF antenna research and development program, 4th Oct. 17, 1954.
Watanabe , T. ; Furutani , K. ; Nakajima , N. et al Antenna switch duplexer for dualband phone (GSM / DCS) using LTCC multilayer technology IEEE MTT-S International Microwave Symposium Digest Jun. 19, 1999.
Dickstein , Harold D. Antenna system for a ground passive electronic reconnaissance facility Symposium on the USAF Antenna Research and Development Program Oct. 20, 1958.
Balanis , Constantine A. Antenna theory—Analysis and Design—Chapter 9 and Chapter 14 Hamilton Printing Jan. 1, 1982.
Balanis , Constantine A. Antenna Theory—Analysis and design—Chapter 10 Hamilton Printing Jan. 1, 1982.
Balanis, Constantine A. Antenna theory—Analysis and design—Chapter 2—Fundamental parameters of antennas John Wiley & Sons Jan. 1, 1982.
Stutzman , W. ; Thiele , G. Antenna theory and design John Wiley and Sons Jan. 1, 1981.
Stutzman , W. L. ; Thiele , G. A. Antenna theory and design John Wiley and Sons Jan. 1, 1998.
Stutzman , W. L. ; Thiele , G. A. Antenna theory and design—Chapter 5—Resonant Antennas: Wires and Patches Wiley Jan. 1, 1998.
Kraus , John D. Antennas—Chapter 2 McGraw-Hill Book Company Jan. 1, 1988.
Saunders , S. R. Antennas and Propagation for Wireless Communication Systems—Chapter 4 John Wiley & Sons Jan. 1, 1999.
The Glenn L. Martin Company Antennas for USAF B-57 series bombers Symposium on the USAF antenna research and development program, 2nd Oct. 19, 1952.
Ingerson , P. G. ; Mayes , P. E. Asymmetrical feeders for log-periodic antennas Symposium on the USAF antenna.research and development program, 17th Nov. 14, 1967.
Wegner , D. E. B-70 antenna system Symposium on the USAF antenna research and development program, 13th Oct. 14, 1963.
Stang , P. F. Balanced flush mounted log-periodic antenna for aerospace vehicles—in Abstracts of the Twelfth Annual Symposium USAF antenna research Symposium on USAF antenna Research and Development, 12th Oct. 16, 1962.
So , P. et al Box-counting dimension without boxes—Computing D0 from average expansion rates Physical Review E Jul. 1, 1999.
DuHamel , R. H. Broadband logarithmically periodic antenna structures IRE International Convention Record Mar. 14, 1957.
Rensh , Y. A. Broadband microstrip antenna Proceedings of the Moscow International Conference on Antenna Theory and Tech Sep. 22, 1998.
Li Wong , K. L. ; Kuo , J. S. ; Fang , S. T. et al Broadband microstrip antennas with integrated reactive loading Asia Pacific Microwave Conference Dec. 3, 1999.
Paschen , D. A. Broadband microstrip matching techniques Antenna Applications Symposium Sep. 21, 1983.
Turner , E. M. Broadband passive electrically small antennas for TV application Proceedings of the 1977 Antenna Applications Symposium Apr. 27, 1977.
Chen , Z. N. Broadband probe-fed L-shaped plate antenna—Exhibit ZZ—Microwave and Optical Technology Letters Aug. 5, 2000.
Gupta , K.C. Broadband techniques for microstrip patch antennas—a review Antenna Applications Sysmposium Sep. 21, 1988.
Seavey , John C-band paste-on and floating ring reflector antennas Symposium on the USAF Antenna Research and Development Program, 23th Oct. 10, 1973.
Peitgen et al, H O Chaos and fractals : new frontiers of science Springer-Verlag Jan. 1, 1992.
Peitgen, Heinz-Otto; Jürgens, Hartmut; Saupe, Dietmar Chaos and fractals. New frontiers of science Springer-Verlag Feb. 12, 1993.
Peitgen , H. ; Jürgens , H. ; Saupe , D. Chaos and Fractals: New frontiers of Science Springer Jan. 1, 1992.
NA Civil cover sheet—Case 6:09-cv-00203 Fractus May 5, 2009.
NA Claims for the EP patent 00909089 Herrero y Asociados Jan. 28, 2005.
NA Collins Dictionary Collins Jan. 1, 1979.

Wall , H. ; Davies , H. W. Communications antennas for mercury space capsule Symposium on the USAF antenna research and development program, 11th Oct. 16, 1961.
Yang , Kai-Ping Compact dual-frequency operation of rectangular microstrip antennas—Antennas and Propagation Society International Symposium, 1999. IEEE Jul. 1, 1999.
Hong , J. S. ; Lancaster , M. J. Compact microwave elliptic function filter using novel microstrip meander open-loop resonators Electronic Letters Mar. 14, 1996.
NA Complaint for patent infringement—Case 6:09-cv-00203 Fractus May 5, 2009.
Jones , H. S. Conformal and Small antenna designs Proceedings of the Antennas Applications Symposium Aug. 1, 1981.
Munson , R. Conformal microstrip array for a parabolic dish Symposium on the USAF Antenna Research and Development Program Oct. 1, 1973.
Munson , R. E. Conformal microstrip communication antenna Symposium on USAF antenna Research and Development, 23th Oct. 10, 1973.
Parker , E. A. ; A. N. A. El Sheikh Convoluted array elements and reduced size unit cells for frequency selective surfaces Iee Proceedings H Feb. 1, 1991.
Love , John D. Court Order. Provisional claim construction and motion fof summary judgement. Provisional markman order—Document 475 Court Nov. 9, 2010.
NA Declaration of Jeffery D. Baxter—Including Exhibits regarding US patent 7411556 Defendants Jul. 30, 2010.
Howe , M. Declaration of Micah Howe in support of Fractus SA opposition to defendants' motion for summary judgement of invalidity based on indefiniteness and lack of written description for certain terms Heim , Payne and Chorus LLP Aug. 16, 2010.
NA Declaration of Thomas E. Nelson—Exhibit A—Antenna photos Defendants Feb. 3, 2011.
NA Defendant's notice of compliance regarding second amended invalidity contentions Defendants Jan. 21, 2011.
NA Defendant's reply in support of their motion for summary judgment of invalidity based on indefiniteness and lack of written description for certain terms Defendants Aug. 30, 2010.
NA Defendant HTC America Inc's answer and counterclaim to plaintiffs amended complaint—Document 176 Defendants Sep. 25, 2009.
NA Defendant HTC America, Inc's first amended answer and counterclaims to plaintiffs amended complaint—Document 191 Defendants Oct. 2, 2009.
NA Defendant HTC America, Inc's answer and counterclaims to plaintiffs second amended complaint—Documents 238 Defendants Dec. 21, 2009.
NA Defendant HTC America, Inc.'s amended answer and counterclaim to plaintiffs second amended complaint—Document 290 Defendants Feb. 24, 2010.
NA Defendant HTC America, Inc.'s amended answer and counterclaim to plaintiffs second amended complaint—Document 298 Defendants Feb. 25, 2010.
NA Defendant HTC Corporation's amended answer and counterclaim to plaintiffs second amended complaint—Document 175 Defendants Sep. 25, 2009.
NA Defendant HTC Corporation's amended answer and counterclaim to plaintiffs second amended complaint—Document 291 Defendants Feb. 24, 2010.
NA Defendant HTC Corporation's amended answer and counterclaim to plaintiffs second amended complaint—Document 297 Defendants Feb. 25, 2010.
NA Defendant HTC Corporation's answer and counterclaims to plaintiffs second amended complaint—Document 239 Defendants Dec. 21, 2009.
NA Defendant HTC Corporation's First amended answer and counterclaim to plaintiffs amended complaint Defendants Oct. 2, 2009.
NA Defendant Pantech Wireless Inc amended answer, affirmative defenses, and counterclaims to Fractus' second amended complaint Defendants Feb. 28, 2011.
NA Defendant Pantech Wireless, Inc's answer, affirmative defenses and counterclaims to Fractus SA's second amended complaint—Document 242 Defendants Dec. 21, 2009.
NA Defendant Pantech Wireless, Inc.'s answer, affirmative defenses and counterclaims to Fractus SA' s Amended complaint—Document 64 Defendants Jun. 4, 2009.
NA Defendant Research in Motion LTD and Research in Motion Corporation's second answer, defenses and counterclaims to plantiff's second amended complaint—Document 241 Defendants Dec. 21, 2009.
NA Defendant Sanyo Electric Co. Ltd's answer to second amended complaint for patent infringement Defendants Dec. 22, 2009.
NA Defendant Sanyo North America Corporation's answer to second amended complaint for patent infringement Defendants Dec. 22, 2009.
NA Defendant Sanyo North America Corporation's partial answer to amended complaint for patent infringement Defendants Jul. 20, 2009.
NA Defendant UTStarcom, Inc's answer affirmative defenses and counterclaims to plaintiffs amended complaint Defendants Jun. 8, 2009.
NA Defendant UTStarcom, Inc's answer, affirmative defenses and counterclaims to Fractus SA's second amended complaint Defendants Dec. 22, 2009.
NA Defendants Invalidity contentions including appendix and exhibits regarding the US patent 7411556 Defendants Feb. 8, 2010.
NA Defendants LG Electronics Inc, LG Electronics USA, and LG Electronics Mobilecomm USA Inc's second amended answer and counterclaim to second amended complaint Defendants Feb. 28, 2011.
NA Defendants LG Electronics Inc., LGg Electronics USA, Inc., and LG Electronics Mobilecomm USA Inc. answer and counterclaim to amended complaint Defendants Oct. 1, 2009.
NA Defendants LG Electronics Inc., LG Electronics USA, Inc., and LG Electronics Mobilecomm USA Inc. answer and counterclaim to second amended complaint Defendants Dec. 28, 2009.
NA Defendants LG Electronics Inc., LG Electronics USA, Inc., and LG Electronics Mobilecomm USA Inc. First amended answer and counterclaim to second amended complaint Defendants Feb. 24, 2010.
NA Defendants LG Electronics Mobilecomm USA., Inc.'s answer and counterclaim to complaint Defendants Oct. 1, 2009.
NA Defendants Research in Motion Ltd, and Research in Motion Corporation's amended answer, defenses and counterclaims to plantiff's amended complaing Defendants Nov. 24, 2009.
NA Defendants Research in Motion Ltd, and Research in Motion Corporation's answers, defenses and counterclaims to plantiff's amended complaint Defendants Oct. 1, 2009.
NA Defendants RIM, Samsung, HTC, LG and Pantech's response to plaintiff Fractus SA's opening claim construction brief in Case 6:09-cv-00203-LED-JDL Defendants Jul. 30, 2010.
NA Defendants RIM, Samsung, HTC, LG and Pantech's response to plaintiff Fractus SAa's opening claim construction brief in Case 6:09-cv-00203-LED-JDL—Exhibit 41—Demonstrative re: counting segments Defendants Jul. 30, 2010.
NA Defendants RIM, Samsung, HTC, LG and Pantech's response to plaintiff Fractus SA's opening claim construction brief in Case 6:09-cv-00203-LED-JDL—Exhibit 42—Demonstrative showing how straight segments can be fitted over a curved surface Defendants Jul. 30, 2010.
NA Defendants RIM, Samsung, HTC, LG and Pantech's response to plaintiff Fractus SA's opening claim construction brief in "Case 6:09-cv-00203-LED-JDL"—Exhibit 1—Chart of Agreed Terms and Disputed Terms Defendants Jul. 30, 2010.
NA Defendants RIM, Samsung, HTC, LG and Pantech's response to plaintiff Fractus SA's opening claim construction brief in "Case 6:09-cv-00203-LED-JDL"—Exhibit 2—Family Tree of Asserted Patents Defendants Jul. 30, 2010.
NA Defendants Samsung Electronics Co Ltd (et al) second amended answer and counterclaims to the second amended complaint of plantiff Fractus SA Defendants Feb. 28, 2011.
NA Defendants Samsung Electronics Co., Ltd.'s; Samsung Electronics Research Institute's and Samsung Semiconductor Europe GMBH's answer; and Samsung Telecommunications America LLC's answer and counterclaim to the amended complaint of plantiff Defendants Oct. 1, 2009.

NA Defendants Samsung Electronics Co., Ltd.'s; Samsung Electronics Research Institute's and Samsung Semiconductor Europe GMBH's first amended answer; and Samsung Telecommunications America LLC's first amended answer—Document 287 Defendants Feb. 24, 2010.
NA Defendants Samsung Electronics Co., Ltd.'s; Samsung Electronics Research Institute's and Samsung Semiconductor Europe GMBH's first amended answer; and Samsung Telecommunications America LLC's first amended answer and—Document 250 Defendants Dec. 23, 2009.
Moheb , H. Design and development of co-polarized ku-band ground terminal system for very small aperture terminal (VSAT) application IEEE International Symposium on Antennas and Propagation Digest Jul. 11, 1999.
McSpadden , J. O. Design and experiments of a high-conversion-efficiency 5.8-GHz rectenna IEEE Transactions on Microwave Theory and Techniques Dec. 1, 1998.
Esteban , J. ; Rebollar , J. M. Design and optimization of a compact Ka-Band antenna diplexer AP-S. Digest Antennas and Propagation Society International Symposium Jun. 18, 1995.
Morishita , H. et al Design concept of antennas for small mobile terminals and the future perspective Antennas and Propagation Magazine, IEEE Oct. 1, 2002.
Manteuffel , Dirk et al Design considerations for integrated mobile phone antennas IEEE Antennas and Propagation, 2001. Eleventh International Conference on (IEE Conf. Publ. No. 480) Apr. 17, 2001.
Campi , M. Design of microstrip linear array antennas Antenna Applications Symposium Aug. 8, 1981.
Azadegan , R. ; Sarabandi , K. Design of miniaturized slot antennas IEEE Antennas and Propagation Society International Symposium Jul. 8, 2001.
Turner , E. M. ; Richard , D. J. Development of an electrically small broadband antenna Symposium on the USAF antenna research and development program, 18th Oct. 15, 1968.
Ikata , O. ; Satoh , Y. ; Uchishiba , H. et al Development of small antenna duplexer using saw filters for handheld phones IEEE Ultrasonics Symposium Oct. 31, 1993.
Ng , V. Diagnosis of melanoma with fractal dimesions IEEE Tencon Jan. 1, 1993.
Borowski , E. J. Dictionary of Mathematics Collins—Case 6:09-cv-00203-LED-JDL Jan. 1, 1989.
NA Dictionary of Scientific and Technical Terms (6 ed) McGraw-Hill Jan. 1, 2002.
Nishikawa , T., Ishikawa , Y., Hattori , J. and Wakino , K. Dielectric receiving filter with Sharp stopband using an active feedback resonator method for cellular base stations IEEE Transactions on Microwave Theory and Techniques Dec. 1, 1989.
Jaggard , D. Diffraction by Bandlimited Fractal Screens Optical Society AM Jun. 1, 1987.
NA Digital cellular telecommunications system (Phase 2) : Types of Mobile Stations (MX) (GSM 02.06) ETSI May 9, 1996.
NA Digital cellular telecommunications system (Phase 2+) ; Radio transmission and reception (GSM 05.05) ETSI Jul. 1, 1996.
NA Digital cellular telecommunications system (Phase2) : Abbreviations and acronyms (GSM01.04) GSM Technical Specification vs. 5.0.0 ETSI Mar. 1, 1996.
NA Digital cellular telecommunications system (Phase2). Mobile Station MS Conformance specifiaction Part 1 Conformance Specification GSM11.10-1) ETSI Mar. 3, 1996.
NA Digital cellular telecommunications system (Phase2); Mobile Station (MS) conformance specification; Part 1: Conformance specification (GSM 11.10-1 version 4.21.1) ETSI Aug. 1, 1998.
Russell , D. A. et al. Dimension of strange attractors Physical Review Letters Oct. 6, 1980.
Kumar , G. ; Gupta , K. Directly coupled multiple resonator wide-band microstrip antennas IEEE Transactions on Antennas and Propagation Jun. 6, 1985.
Guo , Y. X. ; Luk , K. F. Lee ; Chow , Y. L. Double U-slot rectangular patch antenna Electronic Letters Sep. 17, 1998.
Soler , J. ; Romeu , J. Dual-band sierpinski fractal monopole antenna Antennas and Propagation Society International Symposium, 2000. IEEE Jul. 1, 2000.
Maci , S. et al. Dual-band Slot-loaded patch antenna Iee Proceedings Microwave Antennas Propagation Jun. 1, 1995.
Maci , S. et al. Dual-frequency patch antennas Antennas and Propagation Magazine, IEEE Dec. 1, 1997.
Liu , Zi Dong ; Hall , Peter S. ; Wake , David Dual-frequency planar inverted-f antenna Antennas and Propagation, IEEE Transactions on Oct. 1, 1997.
Lu , J. H. ; Wong , K. L. Dual-frequency rectangular microstrip antenna with embedded spur lines and integrated reactive loading Microwave and Optical Technology Letters May 20, 1999.
Wong , K. L. ; Sze , J. Y. Dual-frequency slotted rectangular microstrip antenna Electronic Letters Jul. 9, 1998.
Nakano ; Vichien Dual-frequency square patch antenna with rectangular notch Electronic Letters Aug. 3, 1989.
Chen , H. Dual frequency microstrip antenna with embedded reactive loading Microwave and Optical Technology Letters Nov. 5, 1999.
Chiba , N. et al Dual frequency planar antenna for handsets Electronic Letters Dec. 10, 1998.
Tanner , R. L. ; O'Reilly , G. A. Electronic counter measure antennas for a modern electronic reconnaissance aircraft Symposium on the USAF antenna research and development program, 4th Oct. 17, 1954.
Gray , D. ; Lu , J. W. ; Thiel , D. V. Electronically steerable Yagi-Uda microstrip patch antenna array IEEE Transactions on antennas and propagation May 1, 1998.
Pressley, A Elementary Differential Geometry Springer Jan. 1, 2000.
Weeks , W. L. Eletromagnetic theory for engineering applications John Wiley & Sons Jan. 1, 1964.
Theiler , J. Estimating fractal dimension J. Opt. Soc. Am. A. Case 6:09-cv-00203-LED-JDL Jun. 1, 1990.
Kobayashi , K. Estimation of 3D fractal dimension of real electrical tree patterns Proceedings of the 4th International Conference on Properties and Applications of Dielectric Materials Jul. 1, 1994.
NA European Patent Convention—Article 123—Declaration of Jeffery D. Baxter—Exhibit JJJ European Patent Office Jan. 1, 2000.
NA European Search Report of patent application No. 10180818 dated Dec. 13, 2010 European Patent Office.
Misra , S. Experimental investigations on the impedance and radiation properties of a three-element concentric microstrip square-ring antenna Microwave and Optical TEchnology Letters Feb. 5, 1996.
NA Expert declaration by Dr. D. Jaggard including exhibits (curriculum and datasheets from Cushcraft, Antenova, Ethertronics and Taoglas) Fractus Aug. 16, 2010.
NA FCC—United States table of frequency allocations Federal Communications Commission Oct. 1, 1999.
Cohn , S. B. Flush airborne radar antennas Symposium on the USAF antenna research and development program, 3rd Oct. 18, 1953.
Counter , V. A. ; Margerum , D. L. Flush dielectric disc antenna for radar Symposium on the USAF antenna research and development program, 2nd Oct. 19, 1952.
McDowell , E. P. Flush mounted X-band beacon antennas for aircraft Symposium on USAF antenna Research and Development, 3th Oct. 18, 1953.
Martin, W. R. Flush vor antenna for c-121 aircraft Symposium on the USAF Antenna Research and Development Program, 2nd Oct. 19, 1952.
Counter , V. A. Flush, re-entrant, impedance phased, circularly polarized cavity antenna for missiles Symposium on the USAF antenna research and development program, 2nd Oct. 19, 1952.
Puente , C. ; Romeu , J. ; Cardama , A. Fractal-shaped antennas Frontiers in electromagnetics—IEEE Press Jan. 1, 2000.
Puente , C. ; Anguera , J. ; Romeu , J.; Borja , C. ; Navarro , M. ; Soler , J. Fractal-shaped antennas and their application to gsm 900 1800 Antennas and Propagation Society International Symposium, 2000. IEEE Apr. 1, 2000.
Rouvier , R. et al. Fractal analysis of bidimensional profiles and application to electromagnetic scattering from soils IEEE Jan. 1, 1996.
Berizzi , F. Fractal analysis of the signal scattered from the sea surface Antennas and Propagation, IEEE Transactions on Feb. 1, 1999.
Addison , P. S. Fractal and Chaos an illustrated course—Full Institute of Physics Publising Bristol and Philadelphia Jan. 1, 1997.

Cohen, N. Fractal antenna applications in wireless telecommunications IEEE Electronic Industries Forum of New England, Professional Program Proceedings Boston May 6, 1997.
Kutter , R. E. Fractal antenna design University of Dayton Jan. 1, 1996.
Puente , C. Fractal antennas Universitat Politecnica de Catalunya May 1, 1997.
Szkipala , L. Fractal antennas TEAT Apr. 26, 2001.
Gianvittorio , John Paul et al. Fractal antennas—a novel antenna miniturization technique and applications Antennas and Propagation Magazine, IEEE Feb. 1, 2002.
Penn , A. Fractal dimension of low-resolution medical images Engineering in Medicine and Biology Society, 1996. Proceedings of the 18th Annual International Conference of the IEEE Jan. 1, 1996.
Jaggard , D. L. Fractal electrodynamics and modeling Directions in electromagnetic wave modeling Jan. 1, 1991.
Cohen , N. Fractal element antennas Journal of Electronic Defense Jul. 1, 1997.
Romeu , J. et al Fractal FSS—A novel dual-band frequency selective surface Antennas and Propagation, IEEE Transactions on Jul. 1, 2000.
Mehaute, A. Fractal Geometrics CRC Press—Case 6:09-cv-00203-LED-JDL Jan. 1, 1990.
Falconer , K. Fractal geometry _Full John Wiley Sons—2nd ed. Jan. 1, 2003.
Neary , D. Fractal methods in image analysis and coding Dublin City University Jan. 22, 2001.
Verdura, O. Fractal miniature antenna Universitat Politecnica de Catalunya Sep. 1, 1997.
Puente , C. Fractal multiband antenna based on the Sierpinski gasket Electronic letters Jan. 4, 1996.
Song, C. T. P. Fractal stacked monopole with very wide bandwidth Electronic Letters Jun. 1, 1999.
Walker , G. J. et al Fractal volume antennas Electronic Letters Aug. 6, 1998.
Feder, J. Fractals Plenum Press Jan. 1, 1988.
Barnsley , M. Fractals Everywhere Academic Press Professional Jan. 1, 1993.
Nelson , Thomas R. ; Jaggard , Dwight L. Fractals in the Imaging Sciences J. Optical Society AM. Jan. 1, 1999.
Fleishmann , M. ; Tildesley , DJ ; Balls , RC Fractals in the natural sciences Royal Society of London Jan. 1, 1999.
Feng , J. Fractional box-counting approach to fractal dimension estimation Pattern Recognition, 1996., Proceedings of the 13th International Conference on Jan. 1, 1996.
NA Fractus' Claim Construction Presentation—Markman Hearing—Fractus v. Samsung et al. 609-cv-00203 Sep. 2, 2010 Fractus.
NA Fractus' reply to defendant's motion for reconsideration of, and objections to, magistrate Judge Love's markman order—Document 609 Fractus Feb. 4, 2011.
NA Fractus's opposition to defendants' motion for summary judgement of invalidity based on indefiniteness and lack of written description for certain terms Fractus Aug. 16, 2010.
NA Fractus 's Objections to claim construction memorandum and order. Document 575 Fractus Jan. 14, 2011.
Bhaysar , Samir A. Fractus S.A. v. Samsung Electronics Co., Ltd. et al., 6:09-cv-00203 and Fractus S.A. v. LG Electronics Mobilecomm U.S.A., Inc. et al., 6-09-cv-00205 disclosure of material information to the USPTO Baker Botts LLP Oct. 28, 2009.
NA Fractus SA's opening claim construction brief—Exhibit 2—Parties' Agreed Constructions Fractus Jul. 16, 2010.
NA Fractus SA's opening claim construction brief—Letter Fractus—Case 6:09-cv-00203-LED-JDL Jul. 16, 2010.
NA Fractus SA's opening claim construction brief,—Exhibit 1—Parties' Proposed Constructions—Case 6:09-cv-00203-LED-JDL Fractus Jul. 16, 2010.
NA Fractus vs. Samsung et al. Claim construction and motion for summary judgement—Markman Hearing—[Defendants] Defendants Sep. 2, 2010.
Kuo , Sam Frequency-independent log-periodic antenna arrays with increased directivity and gain Symposium on USAF Antenna Research and Development, 21th Annual Oct. 12, 1971.
Rumsey , V. Frequency independent antennas Academic Press Jan. 1, 1996.
Werner , D. H. ; Werner , P. L. ; Ferrare , A. J. Frequency independent features of self-similar fractal antennas Antennas and Propagation Society International Symposium, 1996. AP-S. Digest Jul. 21, 1996.
Werner , D. H and Mittra , R. Frontiers in electromagnetics IEEE Press Jan. 1, 2000.
Werner , D. H. ; Werner , P. L. ; Jaggard , D. L. ; Jaggard , A. D. ; Puente , C. ; Haupt , R. L. Frontiers in Electromagnetics—Chapter 3—The Theory and design of fractal antenna arrays IEEE Press Series Jan. 1, 2000.
Hansen , R. C. Fundamental limitations in antennas IEEE Proceedings Feb. 1, 1981.
Wheeler , H. A. Fundamental limitations of small antennas Proceedings of the I.R.E. Jan. 1, 1947.
Collier , C. P. Geometry for teachers Waveland Press, Inc. Jan. 1, 1984.
Gillespie , E. S. Glide slope antenna in the nose radome of the F-104 A and B Symposium on the USAF antenna research and development program, 7th Oct. 21, 1957.
NA GSM Technical specification and related materials ETSI Mar. 1, 1996.
NA Hagenuk mobile phone—Antenna photo—Technical specs—User manual Hagenuk Telecom GmbH Jan. 1, 1996.
Matthaei , George L. et al. Hairpin-comb filters for HTS and other narrow-band applications Microwave Theory and Techniques, IEEE Transactions on Aug. 1, 1997.
Cristal , E. G. et al Hairpin-line and hybrid hairpin-line / Half-wave parallel-coupled-line filers Microwave Theory and Techniques, IEEE Transactions on Nov. 1, 1972.
Poularikas , A. Handbook of antennas in wireless communications CRC Press Jan. 1, 2002.
Holzschuh , D. L. Hardened antennas for atlas and titan missile site communications Symposium on the USAF Antenna Research and Development Program, 13th Oct. 14, 1963.
Mayes , P. E. High gain log-periodic antennas Symposium on the USAF antenna research and development program, 10th Oct. 3, 1960.
McDowell , E. P. High speed aircraft antenna problems and some specific solutions for MX-1554 Symposium on the USAF Antenna Research and Development Program, 2nd Oct. 19, 1952.
Vinoy , K. J. et al Hilbert curve fractal antenna: a small resonant antenna for VHF/UHF applications Microwave and Optical Technology Letters May 1, 2001.
Hyneman , R. F. ; Mayes , P. E. ; Becker , R. C. Homing antennas for aircraft ( 450-2500 MC ) Symposium on the USAF antenna research and development program, 5th Oct. 16, 1955.
NA IEEE Standard definitions of terms for antennas, IEEE Std. 145-1983 Antenna Standards Committee of the IEEE Antennas and Propagation Group, USA; Jun. 22, 1983.
NA IEEE Standard Definitions of Terms for Antennas, IEEE Std. 145-1993 (1993) The Institute of Electrical and Electronics Engineers—Case 6:09-cv-00203-LED-JDL Mar. 18, 1993.
NA IEEE Standard Dictionary of Electrical and Electronics Terms IEEE Press (6th ed.) Jan. 1, 1996.
NA IEEE Standard dictionary of electrical and electronics terms IEEE Standard (6th ed.) Jan. 1, 1996.
NA Infringement Chart—Blackberry 8100. Patent: 7411556 Fractus Nov. 5, 2009.
NA Infringement Chart—Blackberry 8110. Patent: 7411556 Fractus Nov. 5, 2009.
NA Infringement Chart—Blackberry 8120. Patent: 7411556 Fractus Nov. 5, 2009.
NA Infringement Chart—Blackberry 8130. Patent: 7411556 Fractus Nov. 5, 2009.
NA Infringement Chart—Blackberry 8220. Patent: 7411556 Fractus Nov. 5, 2009.
NA Infringement Chart—Blackberry 8310. Patent: 7411556 Fractus Nov. 5, 2009.
NA Infringement Chart—Blackberry 8320. Patent: 7411556 Fractus Nov. 5, 2009.
NA Infringement Chart—Blackberry 8330. Patent: 7411556 Fractus Nov. 5, 2009.

NA Infringement Chart—Blackberry 8820. Patent: 7411556 Fractus Nov. 5, 2009.
NA Infringement Chart—Blackberry 8830. Patent: 7411556 Fractus Nov. 5, 2009.
NA Infringement Chart—Kyocera Marbl. Patent: 7411556 Fractus Nov. 5, 2009.
NA Infringement Chart—Kyocera NEO E1100. Patent: 7411556 Fractus Nov. 5, 2009.
NA Infringement Chart—Kyocera S2400. Patent: 7411556 Fractus Nov. 5, 2009.
NA Infringement Chart—LG Aloha LX140. Patent: 7411556 Fractus Nov. 5, 2009.
NA Infringement Chart—LG AX155. Patent: 7411556 Fractus Nov. 5, 2009.
NA Infringement Chart—LG AX380. Patent: 7411556 Fractus Nov. 5, 2009.
NA Infringement Chart—LG AX8600. Patent: 7411556 Fractus Nov. 5, 2009.
NA Infringement Chart—LG Chocolate VX8550. Patent: 7411556 Fractus Nov. 5, 2009.
NA Infringement Chart—LG enV Touch VX1100. Patent: 7411556 Fractus Nov. 5, 2009.
NA Infringement Chart—LG EnV3 VX9200. Patent: 7411556 Fractus Nov. 5, 2009.
NA Infringement Chart—LG Flare LX165. Patent: 7411556 Fractus Nov. 5, 2009.
NA Infringement Chart—LG Lotus. Patent: 7411556 Fractus Nov. 5, 2009.
NA Infringement Chart—LG Muziq LX570. Patent: 7411556 Fractus Nov. 5, 2009.
NA Infringement Chart—LG Rumor. Patent: 7411556 Fractus Nov. 5, 2009.
NA Infringement Chart—LG Shine CU720. Patent: 7411556 Fractus Nov. 5, 2009.
NA Infringement Chart—LG Voyager VX10000. Patent: 7411556 Fractus Nov. 5, 2009.
NA Infringement Chart—LG Vu CU920. Patent: 7411556 Fractus Nov. 5, 2009.
NA Infringement Chart—LG VX5400. Patent: 7411556 Fractus Nov. 5, 2009.
NA Infringement Chart—LG VX5500. Patent: 7411556 Fractus Nov. 5, 2009.
NA Infringement Chart—LG VX8350. Patent: 7411556 Fractus Nov. 5, 2009.
NA Infringement Chart—LG VX8360. Patent: 7411556 Fractus Nov. 5, 2009.
NA Infringement Chart—LG VX8560 Chocolate 3. Patent: 7411556 Fractus Nov. 5, 2009.
NA Infringement Chart—LG VX9400. Patent: 7411556 Fractus Nov. 5, 2009.
NA Infringement Chart—LG Pantech Breeze C520. Patent: 7411556 Fractus Nov. 5, 2009.
NA Infringement Chart—Patench DUO C810. Patent: 7411556 Fractus Nov. 5, 2009.
NA Infringement Chart—Samsung FlipShot SCH-U900. Patent: 7411556 Nov. 5, 2009.
NA Infringement Chart—Samsung M320. Patent: 7411556 Fractus Nov. 5, 2009.
NA Infringement Chart—Samsung SCH-A645. Patent: 7411556 Fractus Nov. 5, 2009.
NA Infringement Chart—Samsung SCH-R430. Patent: 7411556 Fractus Nov. 5, 2009.
NA Infringement Chart—Samsung SCH-R500. Patent: 7411556 Fractus Nov. 5, 2009.
NA Infringement Chart—Samsung SCH-R600. Patent: 7411556 Fractus Nov. 5, 2009.
NA Infringement Chart—Samsung SCH-U310. Patent: 7411556 Fractus Nov. 5, 2009.
NA Infringement Chart—Samsung SCH-U520. Patent: 7411556 Fractus Nov. 5, 2009.
NA Infringement Chart—Samsung SCH-U750. Patent: 7411556 Fractus Nov. 5, 2009.
NA Infringement Chart—Samsung SCH-U940. Patent: 7411556 Fractus Nov. 5, 2009.
NA Infringement Chart—Samsung SCH A127. Patent: 7411556 Fractus Nov. 5, 2009.
NA Infringement Chart—Samsung SCH U340. Patent: 7411556 Fractus Nov. 5, 2009.
NA Infringement Chart—Samsung SCH U410. Patent: 7411556 Fractus Nov. 5, 2009.
NA Infringement Chart—Samsung SCH U700. Patent: 7411556 Fractus Nov. 5, 2009.
NA Infringement Chart—Samsung SGH-A237. Patent: 7411556 Fractus Nov. 5, 2009.
NA Infringement Chart—Samsung SGH-A257. Patent: 7411556 Fractus Nov. 5, 2009.
NA Infringement Chart—Samsung SGH-A437. Patent: 7411556 Fractus Nov. 5, 2009.
NA Infringement Chart—Samsung SGH-A837. Patent: 7411556 Fractus Nov. 5, 2009.
NA Infringement Chart—Samsung SGH-T219. Patent: 7411556 Fractus Nov. 5, 2009.
NA Infringement Chart—Samsung SGH-T559. Patent: 7411556 Fractus Nov. 5, 2009.
NA Infringement Chart—Samsung SGH-T639. Patent: 7411556 Fractus Nov. 5, 2009.
NA Infringement Chart—Samsung SGH-T929. Patent: 7411556 Fractus Nov. 5, 2009.
NA Infringement Chart—Samsung SGH A117. Patent: 7411556 Fractus Nov. 5, 2009.
NA Infringement Chart—Samsung SGH A867. Patent: 7411556 Fractus Nov. 5, 2009.
NA Infringement Chart—Samsung SGH T229. Patent: 7411556 Fractus Nov. 5, 2009.
NA Infringement Chart—Samsung SGH T439. Patent: 7411556 Fractus Nov. 5, 2009.
NA Infringement Chart—Samsung SGH T919. Patent: 7411556 Fractus Nov. 5, 2009.
NA Infringement Chart—Samsung SPH-M550. Patent: 7411556 Fractus Nov. 5, 2009.
NA Infringement Chart—Sanyo Katana LX. Patent: 7411556 Fractus Nov. 5, 2009.
NA Infringement Chart—Sanyo Katanna II. Patent: 7411556 Fractus Nov. 5, 2009.
NA Infringement Chart—Sharp Sidekick LX. Patent: 7411556 Fractus Nov. 5, 2009.
NA Infringement Chart—UTStarcom CDM7126. Patent: 7411556 Fractus Nov. 5, 2009.
NA Int'l Electro-Technical Commission IEV No. 712-01-04—Electropedia : the world's online electrotechnical vocabulary Electropedia—Commission Electrotechnique Internationale—http://www.electropedia.org Apr. 1, 1998.
Nadan , T. ; coupez , J. P. Integration of an antenna filter device, using a multi-layer, multi-technology process European Microwave Conference, 28th Oct. 1, 1988.
Fanjul , J. International Preliminary Examination Report for application No. PCT/ES99/00296 EPO Dec. 19, 2001.
Felgel-Farnholz , W. D. International preliminary examination report of PCT/EP00/00411 dated on Aug. 29, 2002—Notification concerning documents transmitted European Patent Office ( EPO) Aug. 29, 2002.
Rolan Cisneros, E. International Search Report for the PCT patent application ES99/00296 OEPM Mar. 29, 2001.
Caswell , W. E. Invisible errors in dimensions calculations: geometric and systematic effects Dimensions and Entropies in Chaotic Systems Jan. 1, 1986.
Borja , C. ; Puente , C. Iterative network models to predict the performance of Sierpinski fractal antennas and networks Antennas and Propagation Society International Symposium, 1999. IEEE Jul. 11, 1999.
Snow , W. L. Ku-band planar spiral antenna Symposium on the USAF Antenna Research and Development Program, 19th Oct. 14, 1969.
NA Kyocera Communications Inc's answer, affirmative defenses and counterclaims to plaintiffs amended complaint Defendants Jul. 21, 2009.

NA Kyocera Communications, Inc's answer, affirmative defenses and counterclaims to plaintiffs second amended complaint Defendants Dec. 22, 2009.
NA Kyocera Wireless Corp's answer, affirmative defenses and counterclaims to plaintiffs amended complaint Defendants Jul. 21, 2009.
NA Kyocera Wireless Corp's answer, affirmative defenses and counterclaims to plaintiffs second amended complaint Defendants Dec. 22, 2009.
Virga , K. L. Low-profile enhanced-bandwidth PIFA antennas for wireless communications packaging Microwave Theory and Techniques, IEEE Transactions on Oct. 10, 1997.
Parker , S. McGraw-Hill Dictionary of Scientific and Technical Terms (5th ed. 1994) McGraw-Hill—Case 6:09-cv-00203-LED-JDL Jan. 1, 1994.
Sclater , N. ; Markus , J. McGraw-Hill Electronics Dictionary McGraw Hill Jan. 1, 1997.
Schaubert , D. H. ; Chang , W. C. ; Wunsch , G. J. Measurement of phased array performance at arbitrary scan angles Antenna Applications Symposium Sep. 21, 1994.
Love , J. D. Memorandum opinion and order—Document 582 Court Jan. 20, 2011.
Love , J. D. Memorandum order and opinion—Document 526 Court Dec. 17, 2010.
NA Merriam-Webster's Collegiate Dictionary (1993)—Declaration of J. Baxter—Exhibit CC Merriam-Webster's. Case 6:09-cv-00203-LED-JDL Jan. 1, 1993.
Gupta , K. C. ; Benalla , A. Microstrip antenna design Artech House Jan. 1, 1988.
Garg , R. et al. Microstrip antenna design handbook Artech House Jan. 1, 2001.
Carver , K. R. et al. Microstrip antenna technology Antennas and Propagation, IEEE Transactions on Jan. 1, 1981.
Carver , K. R. et al. Microstrip antenna technology in "Microstrip antennas" to D.M. Pozar; IEEE Antennas and Propagation Society Jan. 1, 1995.
Pozar , David M. ; Schaubert , Daniel H. Microstrip antennas. The analysis and design of microstrip antennas and arrays IEEE Press; Pozar, Schaubert Jan. 1, 1995.
Deschamps , G. Microstrip Microwave Antenna Symposium on the USAF Antenna Research and Development Program Oct. 18, 1953.
Munson , R. Microstrip phased array antennas Symposium on the USAF Antenna Research and Development Program, 22th Oct. 11, 1972.
Pozar , David M. Microwave Engineering—Chapter 12: Introduction to Microwave Systems Addison-Wesley Jan. 1, 1990.
Matthaei , George L. Microwave filters impedance-matching networks and coupling structures Artech House Jan. 1, 1980.
Hikita , M. et al Miniature Saw antenna duplexer for 800-Mhz portable telephone used in cellular radio systems Microwave Theory and Techniques, IEEE Transactions on Jun. 1, 1988.
Shibagaki , N. ; Sakiyama , K. ; Hikita , M. Miniature saw antenna duplexer module for 1.9GHz PCN systems using saw-resonator-coupled filters IEEE Ultrasonics Symposium Oct. 5, 1998.
Lancaster , M. J. et al. Miniature superconducting filters Microwave Theory and Techniques, IEEE Transactions on Jul. 1, 1996.
Weman , E. Minutes from Oral Proceedings in accordance with rule 76(4) EPC for EP Application 00909089.5 EPO Jan. 28, 2005.
Soler , J. ; Romeu , J. ; Puente , C. Mod-P Sierpinski fractal multiband antenna Antennas and Propagation Society International Symposium, 2000. IEEE Apr. 4, 2000.
Graf, R Modern dictionary of electronics Butterworth-Heinemann (6th Ed.) Jan. 1, 1984.
Wong , Kin-Lu Modified planar inverted F antenna Electronic Letters Jan. 8, 1998.
NA Motorola 2000x pager Motorola Jun. 13, 1997.
NA Motorola Advisor Elite mobile phone—Antenna photos—User manual Motorola Jan. 1, 1997.
NA Motorola Advisor Gold FLX pager Motorola , Inc Aug. 1, 1996.
NA Motorola Bravo Plus pager Motorola Mar. 3, 1995.
NA Motorola P935 Motorola Aug. 13, 1997.
Borja , C. MSPK product Fractus—Telefonica Jan. 1, 1998.
Mayes , P.E. Multi-arm logarithmic spiral antennas Symposium on the USAF Antenna Research and Development Program, 10th Oct. 3, 1960.
Puente , C. ; Romeu , J. ; Cardama , A. ; Pous , R. Multiband fractal antennas and arrays Fractals engineering—from theory to industrial applications Jan. 1, 1997.
Puente , C. ; Claret , J. ; Sagues , F. et al Multiband properties of a fractal tree antenna generated by electrochemical deposition Electronic Letters Dec. 5, 1996.
Strugatsky , A. et al Multimode multiband antenna Tactical communications: Technology in transition. Proceedings of the tactical communications conference Apr. 28, 1992.
Isbell , D. E. Multiple terminal log-periodic antennas Symposium on the USAF antenna research and development program, 8th Oct. 20, 1958.
Zhang , Dawei ; Liang , G.C. ; Shih , C.F. Narrowband lumped element microstrip filters using capacitively loaded inductors Microwave Symposium Digest, 1995., IEEE MTT-S International May 16, 1995.
Cohen, N. NEC4 analysis of a fractalized monofiliar helix in an axial mode ACES Conference Procedings Apr. 1, 1998.
Hikita , M. ; Shibagaki , N. ; Asal , K. et al New miniature saw antenna duplexer used in GHz-band digital mobile cellular radios IEEE Ultrasonics Symposium Nov. 7, 1995.
Adcock , M. D New type feed for high speed conical scanning Symposium on the USAF Antenna Research and Development Program, 2nd Aug. 11, 1952.
NA Nokia 3210 Nokia Jan. 1, 1999.
NA Nokia 3360 Nokia May 3, 2001.
NA Nokia 8210 Nokia Jan. 1, 1999.
NA Nokia 8260 Nokia Sep. 8, 2000.
NA Nokia 8260—FCC ID GMLNSW-4DX Nokia Apr. 1, 1999.
NA Nokia 8265 Nokia Mar. 4, 2002.
NA Nokia 8290 Nokia Jun. 1, 2010.
NA Nokia 8810 Nokia Jan. 1, 1998.
NA Nokia 8850 Nokia Jun. 1, 1999.
NA Nokia 8860 Nokia and Federal Communications Commission ( FCC) Jun. 24, 1999.
Isbell , D. E. Non-planar logarithmically periodic antenna structures Symposium on the USAF antenna research and development program, 7th Oct. 21, 1957.
Kumar , G. ; Gupta , K. Nonradiating edges and four edges gap-coupled multiple resonator broadband microstrip antennas Antennas and Propagation, IEEE Transactions on Feb. 1, 1985.
Shenoy , A. et al. Notebook satcom terminal technology development International Conference on Digital Satellite Communications, 10th May 15, 1995.
Nguyen , H. Notice of Allowance of U.S. Appl. No. 10/182,635 dated on Apr. 11, 2005 USPTO.
Wimer , M. Notice of allowance of U.S. Appl. No. 10/822,933 dated on Oct. 18, 2007 USPTO.
Phan , T. Notice of allowance of U.S. Appl. No. 10/963,080 dated Sep. 1, 2005. USPTO.
Phan , T. Notice of allowance of U.S. Appl. No. 11/102,390 dated Jul. 6, 2006. USPTO.
Nguyen, H. Notice of Allowance of U.S. Appl. No. 11/110,052 dated on May 30, 2006 USPTO.
Ho , T. Notice of Allowance of U.S. Appl. No. 11/124,768 dated Aug. 29, 2007 USPTO.
Ho , T. Notice of Allowance of U.S. Appl. No. 11/124,768 dated on Apr. 7, 2008 USPTO.
Ho , T. Notice of Allowance of U.S. Appl. No. 11/124,768 dated on May 13, 2006 USPTO.
Phan , T. Notice of allowance of U.S. Appl. No. 11/179,257 dated Oct. 19, 2006 USPTO.
Ho , T. Notice of Allowance of U.S. Appl. No. 11/713,324 dated on May 14, 2008 USPTO.
Ho , T. Notice of Allowance of U.S. Appl. No. 12/055,748 dated Nov. 20, 2009 USPTO.
Ho , T. Notice of Allowance of U.S. Appl. No. 12/055,748 dated on Aug. 12, 2009 USPTO.
Nguyen , H. Notice of Allowance of U.S. Appl. No. 12/347,462 dated on May 18, 2009 USPTO.

NA Notice of compliance with motion practice orders Fractus Feb. 14, 2011.
Hagström , P. Novel ceramic antenna filters for GSM / DECT and GSM / PCN network terminals The 8th IEEE International Symposium on Personal, Indoor and Mobile Radio Communications, 1997. 'Waves of the Year 2000'. PIMRC '97 Sep. 1, 1997.
Lu , J.H. ; Tang , C. L. ; Wong , K. L. Novel dual-frequency and broad-band designs of slot-loaded equilateral triangular microstrip antennas IEEE Transactions on Antennas and Propagation Jul. 1, 2000.
Felgel , F. W. Office Action for European patent application 00909089 dated on Feb. 7, 2003 European Patent Office EPO.
NA Office action for the Chinese patent application 01823716 dated on Feb. 16, 2007 CCPIT Patent and Trademark Law Office—Chinese Patent Office.
NA Office action for the Chinese patent application 01823716 dated Sep. 21, 2007 CCPIT Patent and Trademark Law Office—Chinese Patent Office.
Menefee , James Office Action for the US patent 95/001,389 dated on Aug. 12, 2010 USPTO.
Lee , Benny T. Office action for the U.S. Appl. No. 10/181,790 dated on Aug. 4, 2005 USPTO.
Lee , B. T. Office action for the U.S. Appl. No. 10/181,790 dated on Aug. 27, 2004 USPTO.
Lee , B. T. Office action for the U.S. Appl. No. 10/181,790 dated on Jun. 2, 2005 USPTO.
Lee , B.T Office action for the U.S. Appl. No. 10/181,790 dated on Mar. 2, 2005 USPTO.
Wimer , M. C. Office Action for the U.S. Appl. No. 10/422,578 dated on Aug. 23, 2007 USPTO.
Wimer , M. C. Office Action for the U.S. Appl. No. 10/422,578 dated on Aug. 24, 2005 USPTO.
Wimer , M. C. Office Action for the U.S. Appl. No. 10/422,578 dated on Jan. 26, 2006 USPTO.
Wimer , M. C. Office Action for the U.S. Appl. No. 10/422,578 dated on Mar. 12, 2007 USPTO.
Wimer , M. C. Office action for the U.S. Appl. No. 10/422,578 dated on Mar. 26, 2008 USPTO.
Wimer , M. C. Office Action for the U.S. Appl. No. 11/021,597 dated on Mar. 12, 2007 USPTO.
Menefee , J. Office Action for the US patent reexamination 95/001,390 dated Aug. 12, 2010 USPTO.
Phan , T. Office Action for U.S. Appl. No. 10/102,568 dated on Jan. 23, 2004—Declaration of J. Baxter—Exhibit EEEE—USPTO.
Wimer , Michael Office Action for U.S. Appl. No. 10/422,578 dated on Apr. 7, 2005 USPTO.
Wimer , M. C. Office Action for U.S. Appl. No. 10/422,578 dated on Jun. 23, 2005 USPTO.
Wimer , M. C. Office Action for U.S. Appl. No. 10/822,933 dated on Oct. 5, 2006 USPTO.
Phan , T. Office Action for U.S. Appl. No. 11/550,256 dated on Jan. 15, 2008 USPTO.
Wimer , Michael C. Office Action for U.S. Appl. No. 10/422,578 dated on Oct. 4, 2004 USPTO.
Wimer , M. Office action of U.S. Appl. No. 11/021,597 dated Oct. 30, 2007 USPTO.
Ho , Tan Office Action of U.S. Appl. No. 11/124,768 dated on Aug. 23, 2006 USPTO.
Ho , Tan Office Action of U.S. Appl. No. 11/124,768 dated on Dec. 28, 2007 USPTO.
Ho , Tan Office Action of U.S. Appl. No. 11/124,768 dated on Feb. 21, 2007. USPTO.
Ho , Tan Office Action of U.S. Appl. No. 11/713,324 dated on Feb. 6, 2008 USPTO Feb. 12, 2008.
Ho , Tan Office Action of U.S. Appl. No. 12/055,748 dated on May 28, 2009 USPTO Jun. 3, 2009.
Ho , Tan Office Action of U.S. Appl. No. 12/055,748 dated on Oct. 1, 2008. USPTO Oct. 6, 2008.
Nguyen , H. Office Action of U.S. Appl. No. 12/347,462 dated on Oct. 28, 2009 USPTO.
Ho , Tan Office Action of U.S. Appl. No. 12/652,794 dated on Jun. 23, 2010 USPTO Jun. 29, 2010.
Nguyen , H. Office Action of U.S. Appl. No. 10/182,635 dated Dec. 13, 2004 USPTO Dec. 13, 2004.
Bach Andersen , J. et al. On closely coupled dipoles in a random field Antennas and Wireless Propagation Letters, IEEE Dec. 1, 2006.
Puente , C. ; Romeu , J. ; Cardama , A. ; Pous , R. On the behavior of the Sierpinski multiband fractal antenna Antennas and Propagation, IEEE Transactions on Apr. 1, 1998.
Chen , S. et al. On the calculation of Fractal features from images IEEE Transactions on Pattern Analysis and Machine Intelligence Oct. 1, 1993.
Mandelbrot , B. B. Opinions (Benoit B. Mandelbrot) World Scientific Publishing Company—Case 6:09-cv-00203-LED-JDL Jan. 1, 1993.
NA Order adopting report and recommendation of magistrate judge—Document 622 Court Feb. 11, 2011.
NA Original complaint for patent infringement Downunder Wireless LLC Jun. 29, 2009.
NA Palm Inc.'s answer, affirmative defenses and counterclaims to plaintiffs amended complaint Defendants Jul. 21, 2009.
NA Palm, Inc's answer, affirmative defenses and counterclaims to plaintiffs second amended complaint Defendants Dec. 22, 2009.
Borja , C. Panel 01 Fractus—Telefonica Jan. 1, 1998.
Taga , T. Performance analysis of a built-in planar inverted F antenna for 800 MHz band portable radio units IEEE Journal on Selected Areas in Communication Jan. 1, 1987.
Puente , C. ; Romeu , J. ; Bartolome , R. ; Pous , R. Perturbation of the Sierpinski antenna to allocate operating bands Electronic Letters Nov. 21, 1996.
NA Plaintiff Fractus SA' s answer to defendant Pantech Wireless, Inc' s counterclaims—Document 73 Defendants Jun. 24, 2009.
NA Plaintiff Fractus SA' s answer to defendant UTStarcom, Inc' s counterclaims—Document 79 Fractus Jun. 29, 2009.
NA Plaintiff Fractus, S. A.'s answer to amended counterclaims of defendant HTC America, Inc. To Fractus's Second Amended Complaint—Document 353 Fractus Apr. 1, 2010.
NA Plaintiff Fractus, S. A.'s answer to amended counterclaims of defendant HTC Corporation to Fractus's Second Amended Complaint—Document 352 Fractus Apr. 1, 2010.
NA Plaintiff Fractus, S. A.'s answer to amended counterclaims of defendant LG Electronics Inc., LG Electronics USA, Inc., and LG Electronics Mobilecomm USA Inc's to Fractus's Second Amended Complaint—Document 354 Fractus Apr. 1, 2010.
NA Plaintiff Fractus, S. A.'s answer to amended counterclaims of defendant Samsung Telecommunications America LLC's to Fractus's Second Amended Complaint—Document 351 Fractus Apr. 1, 2010.
NA Plaintiff Fractus, S. A.'s answer to counterclaims of defendant Pantech Wireless, Inc. to the Second Amended Complaint—Document 257 Fractus Jan. 1, 2010.
NA Plaintiff Fractus, S. A.'s answer to counterclaims of defendant Samsung Telecommunications America LLC to the Second Amended Complaint—Document 262 Fractus Jan. 4, 2010.
NA Plaintiff Fractus, S. A.'s answer to counterclaims of defendants HTC America, Inc to the Second Amended Complaint—Document 273 Fractus Jan. 14, 2010.
NA Plaintiff Fractus, S. A.'s answer to counterclaims of defendants LG Electronics Inc., Electronics USA, Inc., and LG Electronics Mobilecomm USA, Inc. to the Second Amended Complaint—Document 263 Fractus Jan. 4, 2010.
NA Plaintiff Fractus, S. A.'s answer to defendant Kyocera Communications, Inc's Counterclaims to the Second Amended Complaint—Document 258 Fractus Jan. 4, 2010.
NA Plaintiff Fractus, S. A.'s answer to defendant Kyocera Wireless Corp's Counterclaims to the Second Amended Complaint—Document 259 Fractus Jan. 4, 2010.
NA Plaintiff Fractus, S. A.'s answer to defendant Palm, Inc's Counterclaims to the Second Amended Complaint—Document 260 Fractus Jan. 4, 2010.
NA Plaintiff Fractus, S. A.'s answer to defendant Personal Communications Devices Holdings, LLC's counterclaims to the Second Amended Complaint—Document 255 Fractus Jan. 4, 2010.
NA Plaintiff Fractus, S. A.'s answer to defendant UTStarcom, Inc's Counterclaims to the Second Amended Complaint—Document 261 Fractus Jan. 4, 2010.

NA Plaintiff Fractus, S. A.'s answer to the counterclaims of defendants Research in Motion Ltd. and Research in Motion Corporation to the Second Amended Complaint—Document 256 Fractus Jan. 4, 2010.
Wong , Kin-Lu Planar antennas for wireless communications_Full Wiley Interscience Jan. 1, 2003.
Teng , P. L. ; Wong , K. L. Planar monopole folded into a compact structure for very-low-profile multiband mobile-phone antenna Microwave and optical technology letters Apr. 5, 2002.
Sauer , J. M. Preliminary amendment for the U.S. Appl. No. 10/963,080—Declaration of J. Baxter—Exhibit W Jones Day. Case 6:09-cv-00203-LED-JDL Dec. 10, 2004.
Walker , B. Preliminary amendment for the U.S. Appl. No. 11/780,932 dated on Jul. 20, 2007 Howison & Arnott—Case 6:09-cv-00203-LED-JDL Jul. 20, 2007.
Wolin , H. A. Preliminary Amendment of U.S. Appl. No. 10/102,568—Exhibit CCCC Rosenman & Colin LLP Mar. 18, 2002.
Shafer , G Probability and Finance John Wiley & Sons Jan. 1, 2001.
Rotman , W. Problems encountered in the design of flush-mounted antennas for high speed aircraft Symposium on the USAF Antenna Research and Development Program, 2nd Oct. 19, 1952.
Pribetich , P. ; Combet , Y. et al Quasifractal planar microstrip resonators for microwave circuits Microwave and Optical Technology Letters Jun. 20, 1999.
Terman , F. E. Radio engineering McGraw-Hill Book Company, Inc. Jan. 1, 1947.
Nakano , Hisamatsu et al Realization of dual frequency and wide band vswr performances using normal mode helical and inverted f antennas Antennas and Propagation, IEEE Transactions on Jun. 6, 1998.
Jaggard , D. L. Rebuttal expert report of Dr. Dwight L. Jaggard (redacted version) Fractus Feb. 16, 2011.
Long , S. A. Rebuttal expert report of Dr. Stuart A. Long (redacted version) Fractus Feb. 16, 2011.
Stutzman , W. L. Rebuttal expert report of Dr. Warren L. Stutzman (redacted version) Fractus Feb. 16, 2011.
Kritikos , H.N. ; Jaggard , D.L. Recent advances in electromagnetic theory—Chapter 6 on fractal electrodynamics Springer—Verlag Oct. 1, 1990.
Hong , J. S. ; Lancaster , J. Recent advances in microstrip filters for communications and other applications IEE Colloquium on Advances in Passive Microwave Components (Digest No. 1997/154) May 22, 1997.
Daniel , A. E. ; Kumar , G. Rectangular microstrip antennas with stub along the non-radiating edge for dual band operation IEEE Antennas and Propagation Society International Symposium Digest Jun. 18, 1995.
NA Reply brief in support of Defendant's motion for reconsideration of the court's ruling on the term "at least a portion" in the court's Dec. 17, 2010 claim construction order based on newly-available evidence—Document 645 Defendants Feb. 25, 2011.
Carpintero , F. Reply to the Written Opinion for the PCT patent application ES99/00296 dated on Nov. 15, 2001—Declaration of J. Baxter—Exhibit FFF—Herrero & Asociados Nov. 15, 2001.
NA Report and recommendation of United States magistrate judge Court Feb. 8, 2011.
Sauer , Joseph M. Request for Continued Examination for U.S. Appl. No. 10/422578 with response to the office action dated on Apr. 7, 2005 and the advisory action dated on Jun. 23, 2005 Jones Day Aug. 8, 2005.
NA Request for inter partes reexamination of US patent 7411556—95/001462 dated Oct. 1, 2010—Exhibits Samsung Oct. 1, 2010.
NA Request for Inter Partes reexamination of US Patent 70115868—OTH-A—Civil Action Case 6:09cv-0203—Second Amended Complaint for patent infringement Fractus Dec. 8, 2009.
NA Request for inter partes reexamination of US patent No. 7411556—95/000590 dated on Dec. 16, 2010—Exhibits Kyocera Dec. 16, 2010.
NA Request for Inter partes reexamination of US patent No. 7411556—95/000600 dated on Dec. 3, 2010—Exhibits HTC Dec. 3, 2010.
NA Response of defendants Kyocera Communications, Inc; Palm Inc. and UTStarcom, Inc. to plaintiff Fractus SA's opening claim construction brief in "Case 6:09-cv-00203-LED-JDL" Defendants Jul. 30, 2010.
Walker , B. D. Response office action for the U.S. Appl. No. 11/179,250 Howison & Arnott—Case 6:09-cv-00203-LED-JDL Jul. 12, 2005.
Moore , S. Response to Office Action dated Feb. 7, 2006 of U.S. Appl. No. 11/033,788 Jenkens & Gilchrist Jun. 1, 2006.
Fractus Response to Office Action for CN patent application 00818542 dated on Nov. 5, 2004 China Council for the Promotion of International Trade Patent and Trademark Office Mar. 31, 2005.
Carpintero , F. Response to Office Action for EP patent application 00909089 dated on Feb. 7, 2003 Herrero y Asociados Aug. 14, 2003.
Lee , B. T. Response to office action for the U.S. Appl. No. 10/181,790 dated on Aug. 27, 2004 USPTO Dec. 8, 2004.
Robinson, R. T. Response to Office Action for U.S. Appl. No. 10/822,933 dated on Oct. 5, 2006 Jenkens & Gilchrist Jan. 4, 2007.
Sauer , Joseph M. Response to the Office Action dated Apr. 7, 2005 for the U.S. Appl. No. 10/422,578 Jones Day May 31, 2005.
Mithani , S. Response to the Office Action dated Mar. 12, 2007 of U.S. Appl. No. 11/021,597 Winstead Aug. 9, 2007.
Mithani , S. Response to the Office Action dated May 28, 2009 of U.S. Appl. No. 12/055,748 Winstead PC Jun. 26, 2009.
Sauer , Joseph M. Response to the Office Action dated Oct. 4, 2004 for the U.S. Appl. No. 10/422,578 Jones Day Jan. 6, 2005.
Tinker J. A. Response to the office action dated Oct. 30, 2007 of U.S. Appl. No. 11/021,597 Winstead Dec. 28, 2007.
NA Response to the office action dated on Feb. 16, 2007 for the Chinese patent application 01823716 CCPIT Patent and Trademark Law Office—Chinese Patent Office Aug. 21, 2007.
NA Response to the office action dated on Sep. 21, 2007 for the Chinese patent application 01823716 CCPIT Patent and Trademark Law Office—Chinese Patent Office Dec. 3, 2007.
Sauer, J.M. Response to the office action from U.S. Appl. No. 10/181,790 dated Jun. 2, 2005 Jones Day Jul. 20, 2005.
Sauer , J. M. Response to the office action from U.S. Appl. No. 10/181,790 dated Mar. 2, 2005 Jones Day Mar. 14, 2005.
Sauer , J. M. Response to the Office Action mailed on Jan. 26, 2006 and Advisory Action mailed on Mar. 29, 2006 for the U.S. Appl. No. 10/422,578 Jones Day May 1, 2006.
Carpintero , F. Response to the summons to attend oral proceedings of European patent application No. 02808256.9 dated on Oct. 21, 2010 Herrero & Asociados.
Rich , Barnett Review of Elementary Mathematics 2d ed.1997 McGraw—Hill—Case 6:09-cv-00203-LED-JDL Jan. 1, 1997.
NA RIM 857 pager RIM Oct. 1, 2000.
NA RIM 950 product—Photos of RIM Jun. 30, 1998.
NA RIM 957 page maker RIM Nov. 15, 2000.
NA Rockwell B-1B Lancer <http://home.att.net/~jbaugher2/newb1_2.html> Oct. 12, 2001.
Shibagaki , N. Saw antennas duplexer module using saw-resonator-coupled filter for PCN system IEEE Ultrasonics symposium Oct. 5, 1998.
NA Second amended complaint for patent infringement—Case 6:09-cv-00203—Document 222 Fractus Dec. 2, 2009.
Mushiake, Yasuto Self-Complementary Antennas : Principle of Self Complementarity for Constant Impedance Springer-Verlag Jan. 1, 1996.
Hohlfeld , R. G. ; Cohen N. Self-similarity and the geometric requirements for frequency independence in antennae Fractals Jan. 17, 1999.
Pan, S. et al. Single-feed dual-frequency microstrip antenna with two patches Antennas and Propagation Society International Symposium, 1999. IEEE Aug. 1, 1999.
Lu , Jui-Han Single-feed dual-frequency rectangular microstrip antenna Antennas and Propagation Society International Symposium, 2000. IEEE Jul. 1, 2000.
Lu , Jui-Han ; Tang , Chia-Luan ; Wong , Kin-Lu Single-feed slotted equilateral triangular microstrip antenna for circular polarization Antennas and Propagation, IEEE Transactions on Jul. 1, 1999.
Huynh , T. ; Lee , K. F. Single-layer single-patch wideband microstrip antenna Electronic Letters Aug. 3, 1995.

Lu , Jui-Han et al. Slot-loaded, Meandered Rectangular Microstrip Antenna With Compact Dualfrequency Operation IEEE Electronics Letters May 28, 1998.
Wheeler , H. A. Small antennas Symposium on the USAF antenna research and development program, 23rd Oct. 10, 1973.
Dou , W. Small broadband stacked planar monopole Wiley InterScience Nov. 20, 2000.
Puente , C. et al Small but long Koch fractal monopole Electronic Letters Jan. 8, 1998.
NA Software—Box counting dimension [electronic] http://www.sewanee.edu/Physics/PHYSICS123/
Box%20COUNTING%20DIMENSION.html Apr. 1, 2002.
Mayes , P. Some broadband , low-profile antennas Antenna Applications Symposium Sep. 18, 1985.
Chen , Wen-Shyang Square-ring microstrip antenna with a cross strip for compact circular polarization operation Antennas and Propagation, IEEE Transactions on Oct. 1, 1999.
Paschen , D. A. Structural stopband elimination with the monopole-slot antenna Antenna Applications Symposium Sep. 22, 1982.
Gilbert , R. ; Pirrung , A. ; Kopf , D. et al. Structurally-integrated optically-reconfigurable antenna array Antenna Applications Symposium Sep. 20, 1995.
Misra , S. ; Chowdhury , S. K. Study of impedance and radiation properties of a concentric microstrip triangular-ring antenna and Its modeling techniques using FDTD method IEEE Transactions on Antennas and Propagation Apr. 1, 1998.
Campos, O. Study of multiband and miniature fractal antennas Universitat Politecnica de Catalunya Jan. 1, 1998.
Parron , J. ; Rius , J. ; Romeu , J. Study of the Koch fractal monopole in the frequency domain Fractalcoms May 30, 2002.
Jaschke , H. ; Ribbe , J. ; Von Walter , S. Summons to attend oral proceedings in connection with the European patent application No. 02808265.9 dated on Jun. 25, 2010. European Patent Office—EPO Jun. 30, 2010.
NA Summons to attend oral proceedings pursant to rule 71 (1) EPC for EP application 00909089 EPO Oct. 28, 2004.
Force , R. et al. Synthesis of multilayer walls for radomes of aerospace vehicles Symposium on the USAF Antenna Research and Development Program Nov. 14, 1967.
Scharfman , W. Telemetry antennas for high altitude missiles Symposium on the USAF antenna research and development program, 8th Oct. 20, 1958.
NA The American Century Dictionary Oxford University Press Jan. 1, 1995.
NA The American Heritage College Dictionary Houghton Mifflin Comp.—3d ed.—Case 6:09-cv-00203-LED-JDL Jan. 1, 1997.
NA The American Heritage Dictionary New College ed. (2nd ed. ) Jan. 1, 1982.
NA The American Heritage Dictionary Morris—William—(Second College edition)—Case 6:09-cv-00203-LED-JDL Jan. 1, 1982.
Tang , Y. The application of fractal analysis to feature extraction IEEE Jan. 1, 1999.
Bushman , F.W The boeing B-52 all flush antenna system Symposium on the USAF Antenna Reseach and Development Program, 5th Oct. 16, 1955.
Rademacher , H. ; Toeplitz , O. The Enjoyment of Math Princeton Science Library Jan. 1, 1957.
Dyson , J. D. The equiangular spiral antenna Antennas and Propagation, IRE Transactions on Apr. 1, 1959.
Mandelbrot, B The fractal geometry of nature Freeman and Company Jan. 1, 1982.
Best , Steven R. The fractal loop antenna: a comparison of fractal and non-fractal geometries Antennas and Propagation Society International Symposium, 2001. IEEE Jan. 1, 2001.
Blackband , W. T. The handbook of antenna design—Chapter 18—Coaxial transmisison lines and components Rudge , A. W. et al.Peter Peregrinus Jan. 1, 1986.
Blackband , W. T. The handbook of antenna design—Chapter 18—Coaxial transmission lines and components Rudge , A. W. et al—IEE Eletromagnetic Waves Series; Peter Peregrinus Ltd. Jan. 1, 1986.
NA The handbook of antenna design—Index Rudge, A. W. et al.—Peter Peregrinus—Institution of Electrical Engineers Jan. 1, 1986.
Puente , C. ; Romeu , J. ; Cardama, A. The Koch monopole—a small fractal antenna Antennas and Propagation, IEEE Transactions on Nov. 1, 2000.
Buczkowski , Stephane ; Kyriacos , Soula ; Nekka , Fahima ; Cartilier , Louis the modified box-countig method: analysis of some characteristic paramenters Pattern Recognition Apr. 20, 1998.
Collier , D. ; Shnitkin , H. The monopole as a wideband array antenna element Antenna Applications Symposium Sep. 22, 1993.
Kurpis , G. P. The New IEEE standard dictionary of electrical and electronics terms IEEE Standards Jan. 1, 1993.
Dyson , J. D. The non-planar equiangular spiral antenna Symposium on the Usaf Antenna Research and Development Program Oct. 20, 1958.
Henderson West , B The Prentice-Hall encyclopedia of mathematics Prentice-Hall Jan. 1, 1982.
West , B.H. et al. The Prentice-Hall Encyclopedia of Mathematics (1982) Prentice-Hall—Case 6:09-cv-00203-LED-JDL Jan. 1, 1982.
Wheeler , H. A. The radiansphere around a small antenna Proceedings of the IRE Aug. 1, 1959.
NA The Random House Dictionary Random House Jan. 1, 1984.
Peitgen & D. Saupe, H The science of fractal images Springer-Verlag Jan. 1, 1988.
Lo , Y. T. ; Solomon , D. ; Richards , W. F. Theory and experiment on microstrip antennas Antenna Applications Symposium Sep. 20, 1978.
Sinclair, G. Theory of models of electromagnetic systems Proceedings of the IRE Nov. 1, 1948.
Du Plessis , M. ; Cloete , J. H. Tuning stubs for microstrip patch antennas AP-S. Digest Antennas and Propagation Society International Symposium Jun. 28, 1993.
Snow , W. L. UHF crossed-slot antenna and applications Symsposium on the USAF Antenna Research and Development program, 19th Sep. 1, 1963.
NA United States Table of Frequency allocations—The Radio Spectrum United States Department of Commerce Mar. 1, 1996.
Batson , D. D. et al VHF unfurlable turnstile antennas Symposium USAF antenna research and development program, 19th Oct. 14, 1969.
NA Webster's New Collegiate Dictionary G & C Merriam Co. Jan. 1, 1981.
Dubost , G. Wideband flat dipole and short-circuit microstrip patch elements and arrays. In Handbook of microstrip antennas—Chapter 7 Peter Peregrinus Ltd. James , J. R. ; Hall , P. S. (ed.) Jan. 1, 1989.
Carpintero , F. Written submissions for EP application 00909089 Herrero y Asociados Dec. 15, 2004.
NA Fractus SA's Opening Claim Construction Brief with Parties' Proposed and Agreed Constructions in the case of *Fractus SA* v. *Samsung Electornics Co. Ltd. et al.* Fractus—Case 6:09-cv-00203-LED-JDL. Jul. 16, 2010.
Jaggard , D. L. Expert report of Dwight L. Jaggard (redacted)—expert witness retained by Fractus. Fractus Feb. 23, 2011.
Long , S. Expert report of Stuart Long (redacted)—expert witness retained by Fractus. Fractus Feb. 23, 2011.
Stutzman , W. L. Expert report of Dr. Warren L. Stutzman (redacted)—expert witness retained by Fractus. Fractus Feb. 23, 2011.
Sterne , R. G. Response to the Office Action for the US patent 95/001390 dated on Aug. 19, 2010 Sterne, Kessler, Goldstein & Fox PLLC. Nov. 19, 2010.
NA. Letter from Baker Botts to Howison & Arnott LLP including exhibits Baker. Botts Aug. 5, 2010.
NA. Letter from Baker Botts to Kenyon & Kenyon LLP, Winstead PC and Howison & Arnott LLP including exhibits. Baker Botts Oct. 28, 2009.
Naik , A. ; Bathnagar , P. S. Experimental study on stacked ring coupled triangular microstrip antenna Antenna Applications Symposium, 1994. Sep. 21, 1994.
NA. Letter to FCC—Application form 731 and Engineering Test Report by Nokia Mobile Phones for FCC ID: LJPNSW-6NX M. Flom Associates Apr. 1, 1999.
NA. OET Exhibits list for FCC ID: LJPNSW-6NX Federal Communications Commission—FCC Jul. 8, 1999.

Wikka , K. Letter to FCC that will authorize the appointment of Morton Flom Eng and/or Flomassociates Inc to act as their Agent in all FCC matters. Nokia Mobile Phones Aug. 5, 1999.
Posio , E. Letter to FCC—Request for confidentiality on the information accompanying the application of FCC ID: GLMNSW-4DX. Nokia Mobile Phones Feb. 7, 2000.
NA. OET Exhibits List for FCC ID: GMLNSW-4DX. Office of Engineering and Technology—FCC Sep. 8, 2000.
Nokia Mobile Phones. Exhibit 9: Internal Photographs FCC ID: LJPNPW-1NB Federal Communication Commission—FCC. Feb. 15, 2001.
NA. OET Exhibits list for FCC ID: LJPNPW-1NB Federal Communications Commission—FCC May 3, 2001.
Watson , T. ; Friesser , J. A phase shift direction finding technique Annual Symposium on the USAF antenna research and development program Oct. 21, 1957.
McCormick , J. A Low-profile electrically small VHF antenna 15th Annual Symposium on the USAF antenna reserach and development program Oct. 12, 1965.
Lyon , J. ; Rassweiler , G. ; Chen , C. Ferrite-loading effects on helical and spiral antennas 15th Annual Symposium on the USAF antenna reserach and development program Oct. 12, 1965.
Paschen , D. A. ; Olson , S. A crossed-slot antenna with an infinite balun feed Antenna Applications Symposium, 1995. Sep. 20, 1995.
Posio , E. Letter to FCC—Electronic Serial Number for FCC ID: GMLNPW-4DX Nokia Mobile Phones Feb. 7, 2000.
Posio , E. Letter to FCC about GMLNSW-4DX complies with ANSI/IEEE C95.1-1992 Standard for Safety Levels Nokia Mobile Phones Mar. 7, 2000.
Graff , W. Letter to FCC—Test Report GMLNSW-4DX M. Flom Associates—MFA Mar. 17, 2000.
Graff , B. Form 731 Corrections: GMLNSW-4DX M. Flom Associates—MFA Apr. 24, 2000.
Flom , M. Letter to FCC—Nokia SAR Information M. Flom Associates —MFA May 19, 2000.
Flom , M. Letter to FCC—Communication of replacing employee M. Flom Associates May 23, 2000.
Myrskog , M Letter to FCC—Letter that will authorize the appointment of Morton Flom Eng and/or Flomassociates Inc to act as their Agent in all FCC matters Nokia Mobile Phones Sep. 14, 2000.
NA SAR—Evaluation—DASY3 Dipole ValidationKit—Type: D1900V2—Serial: 511 Schimd and Partner Engineering AG Feb. 13, 2001.
NA SAR—Evaluation—DASY3 Dipole ValidationKit—Type: D835V2—Serial: 405 Schmid and Partner Engineering AG Feb. 13, 2001.
Salow , S. Letter to FCC—About LJPNPW-1 NB complies with ANSI/IEEE C95.1-1992 Standard for Safety Levels Nokia Mobile Phones Feb. 26, 2001.
Salow , S. Letter to FCC—FCC ID LJPNPW-1NB complies with ETt Bulletin No. 53 as referenced in Section 22.915 of the Commissions rules and with EIA/TIA/IS-54-B Nokia Mobile Phones Feb. 26, 2001.
Salow , S. Request for confidentiality of the information accompanyinh the application of FCC ID: LJPNPW-1NB M. Flom Associates—MFA Feb. 26, 2001.
Flom , M. Letter to FCC—Application form 731 and Engineering Test Report by Nokia Mobile Phones for FCC ID: LJPNPW-1NB M. Flom Associates—MFA Mar. 12, 2001.
Flom , M. Letter to modify the Emission Designator M. Flom Associates—MFA Mar. 30, 2001.
Zhang , S. Huff , G. ; Bernhard , T. Antenna efficiency and gain of two new compact microstrip antennas Antenna Applications symposium, 2001 Sep. 19, 2001.
Posio , E. Letter to FCC—About GMLNPW-3 complies with ANSI/IEEE C95.1-1992 Standard for Safety Levels Nokia Mobile Phones Dec. 7, 2001.
Posio , E. Letter to FCC—Compliance Statement of GMLNPW-3 Nokia Mobile Phones Dec. 7, 2001.
Poiso , E. Letter to FCC—Electronic Serial Number for FCC ID: GMLNPW-3 Nokia Mobile Phones Dec. 7, 2001.
Posio , E. Letter to FCC—Request for confidentiality of the information accompanying the application of FCC ID: GMLNPW-3 Nokia Mobile Phones Dec. 7, 2001.
Ewing , A Letter and Engineering Test Report of FCC ID: GMLNPW-3 Test and Certification Center—TCC Dec. 19, 2001.
NA Nokia. Antenna Photos—FCC ID: GLMNPW-3 Federal Communications Commission—FCC Feb. 19, 2002.
Nokia Nokia MBD-11 Mobile Holder—SAR Specification Nokia Mar. 1, 2002.
IEEE Standards Uncertainty System Check (Dipole Validation)—IEEE P1528 Schmid and Partner Engineering AG Jan. 1, 2003.
Meier , K. ; Burkhard , M. ; Schmid , T. et al Broadband calibration of E-field probes in Lossy Media IEEE Transactions on Microwave Theory and Techniques Oct. 1, 1996.
NA Fractus's sur-reply to defendants' motion for reconsideration of the court's Dec. 17, 2010 claim construction order based on newly-available evidence—Document 666 Fractus Mar. 8, 2011.
NA Order—Document 670 Court Mar. 9, 2011.
NA Plaintiff Fractus SA's answer to second amended counterclaims of defendant HTC Corporation to Fractus's second amended complaint—Document 678 Fractus Mar. 14, 2011.
NA Plaintiff Fractus SA's answer to second amended counterclaims of defendant HTC to Fractus's second amended complaint—Document 680 Fractus Mar. 14, 2011.
NA Plaintiff Fractus SA's answer to second amended counterclaims of defendant LG Electronics to Fractus's second amended complaint—Document 694 Fractus Mar. 15, 2011.
NA Plaintiff Fractus SA's answer to second amended counterclaims of defendant Samsung to Fractus's second amended complaint—Document 695 Fractus Mar. 15, 2011.
NA Plaintiff Fractus SA's answer to amended counterclaims of defendant Pantech Wireless Inc to Fractus's second amended complaint—Document 696 Fractus Mar. 15, 2011.
Davis, Leonard Order—Document 783. United States District Judge Apr. 1, 2011.
Tribble, M. L. Letter to John D. Love—Document 715—Permission to file a summary judgment motion of no. indefiniteness on the issues wher the Court's Report and Recommendation already has held that the claim term is not indefinite Susman Godfrey Mar. 18, 2011.
Tribble , M. L. Letter to John D. Love—Document 716—Permission to file a partial summary judgement motion on infringement. Susman Godfrey , LLP Mar. 18, 2011.
Sirola, Neil P. Letter to John D. Love—Document 721—Permission to file a motion for summary judgment of invalidity of the following 7 asserted claims from the Mlv, patent family . . . Baker Botts, LLP Mar. 18, 2011.
Howe , Micah J. Fractus, S.A.'s objections to the Court's Mar. 9, 2011, Order—Document 768 Susman Godfrey LLP Mar. 25, 2011.
Jones, Michael E. Defendants' opposition to Fractus SA objections to the Court's Mar. 9, 2011 Order—Document 780 Baker Botts, LLP Mar. 31, 2011.
NA Stipulation of Dismissal of all Claims and Counterclaims re '850 and '822—Document 841 Defendants Apr. 15, 2011.
NA Joint Motion to Dismiss Claims and Counterclaims re '850 and '822—Document 843 Defendants Apr. 15, 2011.
NA Defendants' Motion to Clarify Claim Construction—Document 854 Defendants Apr. 18, 2011.
Love , J. D. Order—Document 868 United States Magristrate Judge Apr. 19, 2011.
Behncke , M. Fractus's surreply to defendants' Motion for Summary Judgment re publication dates of three references—Document 876 Susman Godfrey LLP Apr. 20, 2011.
Howe , M. Fractus's Response to Defendants' Motion to Clarify Claim Construction—Document 887 Susman and Godfrey Apr. 45, 2011.
Love , J. Minute Entry re Hearing on Apr. 21, 2011—Document 890 United States Distric Court for the Eastern Distric of Texas—Tyler Division Apr. 27, 2011.
NA Infringement Chart—UTStarcom CDM7126. Fractus Nov. 5, 2009.
NA Infringement Chart—Sanyo Katana II. Fractus Nov. 5, 2009.
NA Infringement Chart—Sanyo Katana LX Fractus Nov. 5, 2009.
NA Infringement Chart—Samsung SPH-M550 Fractus Nov. 5, 2009.

NA Infringement Chart—Samsung SGH T919 Fractus Nov. 5, 2009.
NA Infringement Chart—Samsung SGH T439 Fractus Nov. 5, 2009.
NA Infringement Chart—Samsung SGH T229 Fractus Nov. 5, 2009.
NA Infringement Chart—Samsung SGH A867 Fractus Nov. 5, 2009.
NA Infringement Chart—Samsung SGH A117 Fractus Nov. 5, 2009.
NA Infringement Chart—Samsung SGH-T929 Fractus Nov. 5, 2009.
NA Infringement Chart—Samsung SGH-T639 Fractus Nov. 5, 2009.
NA Infringement Chart—Samsung SGH-T559 Fractus Nov. 5, 2009.
NA Infringement Chart—Samsung SGH-T219. Fractus Nov. 5, 2009.
NA Infringement Chart—Samsung SGH-A837 Fractus Nov. 5, 2009.
NA Infringement Chart—Samsung SGH A437 Fractus Nov. 5, 2009.
NA Infringement Chart—Samsung SGH-A257 Fractus Nov. 5, 2009.
NA Infringement Chart—Samsung SGH-A237 Fractus Nov. 5, 2009.
NA Infringement Chart—Samsung SCH U700 Fractus Nov. 5, 2009.
NA Infringement Chart—Samsung SCH U410. Fractus Nov. 5, 2009.
NA Infringement Chart—Samsung SCH U340. Fractus Nov. 5, 2009.
NA Infringement Chart—Samsung SCH A127. Fractus 20091105.
NA Infringement Chart—Samsung SCH-U940 Fractus Nov. 5, 2009.
NA Infringement Chart—Samsung SCH-U750 Fractus Nov. 5, 2009.
NA Infringement Chart—Samsung SCH-U520 Fractus Nov. 5, 2009.
NA Infringement Chart—Samsung SCH-U310 Fractus Nov. 5, 2009.
NA Infringement Chart—Samsung SCH-R600 Fractus Nov. 5, 2009.
NA Infringement Chart—Samsung SCH-R500. Fractus Nov. 5, 2009.
NA Infringement Chart—Samsung SCH-R430 Fractus Nov. 5, 2009.
NA Infringement Chart—Samsung SCH-A645 Fractus Nov. 5, 2009.
NA Infringement Chart—Samsung M320 Fractus Nov. 5, 2009.
NA Infringement Chart—Samsung FlipShot SCH-U900 Fractus Nov. 5, 2009.
NA Infringement Chart—Pantech DUO C810. Fractus Nov. 5, 2009.
NA Infringement Chart—Pantech Breeze C520. Fractus Nov. 5, 2009.
NA Infringement Chart—LG VX9400 Fractus Nov. 5, 2009.
NA Infringement Chart—LG VX8560 Chocolate 3 Fractus Nov. 5, 2009.
NA Infringement Chart—LG VX8360. Fractus Nov. 5, 2009.
NA Infringement Chart—LG VX8350 Fractus Nov. 5, 2009.
NA Infringement Chart—LG VX5500 Fractus Nov. 5, 2009.
NA Infringement Chart—LG VX5400 Fractus Nov. 5, 2009.
NA Infringement Chart—LG VU CU920 Fractus Nov. 5, 2009.
NA Infringement Chart—LG Voyager VX10000 Fractus Nov. 5, 2009.
NA Infringement Chart—LG Shine CU720 Fractus Nov. 5, 2009.
NA Infringement Chart—LG Rumor Fractus Nov. 5, 2009.
NA Infringement Chart—LG MUZIQ LX570 Fractus Nov. 5, 2009.
NA Infringement Chart—LG Lotus Fractus Nov. 5, 2009.
NA Infringement Chart—LG Flare LX165 Fractus Nov. 5, 2009.
NA Infringement Chart—LG EnV3 VX9200. Fractus Nov. 5, 2009.
NA Infringement Chart—LG enV Touch VX1100. Fractus Nov. 5, 2009.
NA Infringement Chart—LG Chocolate VX8550 Fractus Nov. 5, 2009.
NA Infringement Chart—LG AX8600 Fractus Nov. 5, 2009.
NA Infringement Chart—LG AX380 Fractus Nov. 5, 2009.
NA Infringement Chart—LG AX155. Fractus Nov. 5, 2009.
NA Infringement Chart—LG Aloha LX140. Fractus Nov. 5, 2009.
NA Infringement Chart—Kyocera S2400 Fractus Nov. 5, 2009.
NA Infringement Chart—Kyocera NEO E1100 Fractus Nov. 5, 2009.
NA Infringement Chart—Kyocera Marbl Fractus Nov. 5, 2009.
NA Infringement Chart—RIM Blackberry 8830 Fractus Nov. 5, 2009.
NA Infringement Chart—RIM Blackberry 8820 Fractus Nov. 5, 2009.
NA Infringement Chart—RIM Blackberry 8330 Fractus Nov. 5, 2009.
NA Infringement Chart—RIM Blackberry 8320 Fractus Nov. 5, 2009.
NA Infringement Chart—RIM Blackberry 8310 Fractus Nov. 5, 2009.
NA Infringement Chart—RIM Blackberry 8220 Fractus Nov. 5, 2009.
NA Infringement Chart—RIM Blackberry 8130 Fractus Nov. 5, 2009.
NA Infringement Chart—RIM Blackberry 8120 Fractus Nov. 5, 2009.
NA Infringement Chart—RIM Blackberry 8110 Fractus Nov. 5, 2009.
NA Infringement Chart—RIM Blackberry Pearl 8100 Fractus Nov. 5, 2009.
Menefee , J. Office Action of US patent application No. 95/000590 and 95/001462 dated on May 6, 2011 USPTO.
Ho , T. Office Action of U.S. Appl. No. 12/652,974 dated Jun. 23, 2010 USPTO.
Shoaib , M. Response to the Office Action dated on Jun. 23, 2010 of U.S. Appl. No. 12/652,974 Winstead Dec. 20, 2010.
Ho , T. Notice of Allowance of U.S. Appl. No. 12/652,974 dated on Feb. 17, 2011 USPTO.
Inter partes reexamination of US patent 7411556—95/001462 , 95/001590—Third party requesters comments to patent owners reply of Aug. 8, 2011, dated on Sep. 7, 2011.
Decision sua sponte to merge reexamination proceedings of US patent 7411556—95/000590—95/001462—dated on May 5, 2011.
Response to the Office Action dated May 6, 2011 of US patent US7411556—95/001462—95/000590—, dated on Aug. 6, 2011.
Notice of allowance of U.S. Appl. No. 12/652,974 dated on Aug. 10, 2011.
US95/001462 , 95/000,590—Third party requesters notice of appeal for US patent 7411556, dated Apr. 12, 2012.
US95/001462, 95/000,590—Reply to Third Party Requester's notice of appeal filed on Apr. 12, 2012 for US patent 7411556, dated May 31, 2012.
U.S. Appl. No. 12/652,974—Notice of allowance, dated May 21, 2012.

* cited by examiner

MULTI-BAND MONOPOLE ANTENNA FOR A MOBILE COMMUNICATIONS DEVICE

CROSS-REFERENCE TO RELATED APPLICATIONS

This patent application is a continuation of U.S. patent application Ser. No. 12/652,974, filed on Jan. 6, 2010. U.S. patent application Ser. No. 12/652,974 is a continuation of Ser. No. 12/055,748, filed on Mar. 26, 2008, now U.S. Pat. No. 7,675,470, issued on Mar. 9, 2010. U.S. Pat. No. 7,675,470 is a continuation of Ser. No. 11/713,324, filed on Mar. 2, 2007, now U.S. Pat. No. 7,403,164, issued on Jul. 22, 2008. U.S. Pat. No. 7,403,164 is a continuation of Ser. No. 11/124,768, filed on May 9, 2005, now U.S. Pat. No. 7,411,556, issued on Aug. 12, 2008. U.S. Pat. No. 7,411,556 is a continuation of International Patent Application No. PCT/EP02/14706, filed on Dec. 22, 2002. U.S. patent application Ser. No. 12/652,974, U.S. Pat. No. 7,675,470, U.S. Pat. No. 7,403,164, U.S. Pat. No. 7,411,556, and International Patent Application No. PCT/EP02/14706 are incorporated herein by reference.

BACKGROUND OF THE INVENTION

1. Technical Field of the Invention

This invention relates generally to the field of multi-band monopole antennas. More specifically, a multi-band monopole antenna is provided that is particularly well-suited for use in mobile communications devices, such as Personal Digital Assistants, cellular telephones, and pagers.

2. Description of Related Art

Multi-band antenna structures for use in a mobile communications device are known in this art. For example, one type of antenna structure that is commonly utilized as an internally-mounted antenna for a mobile communication device is known as an "inverted-F" antenna. When mounted inside a mobile communications device, an antenna is often subject to problematic amounts of electromagnetic interference from other metallic objects within the mobile communications device, particularly from the ground plane. An inverted-F antenna has been shown to perform adequately as an internally mounted antenna, compared to other known antenna structures. Inverted-F antennas, however, are typically bandwidth-limited, and thus may not be well suited for bandwidth intensive applications.

SUMMARY OF THE INVENTION

A multi-band monopole antenna for a mobile communications device includes a common conductor coupled to both a first radiating arm and a second radiating arm. The common conductor includes a feeding port for coupling the antenna to communications circuitry in a mobile communications device. In one embodiment, the first radiating arm includes a space-filling curve. In another embodiment, the first radiating arm includes a meandering section extending from the common conductor in a first direction and a contiguous extended section extending from the meandering section in a second direction.

A mobile communications device having a multi-band monopole antenna includes a circuit board, communications circuitry, and the multi-band monopole antenna. The circuit board includes an antenna feeding point and a ground plane. The communications circuitry is coupled to the antenna feeding point of the circuit board. The multi-band monopole antenna includes a common conductor, a first radiating arm and a second radiating arm. The common conductor includes a feeding port that is coupled to the antenna feeding point of the circuit board. The first radiating arm is coupled to the common conductor and includes a space-filling curve. The second radiating arm is coupled to the common conductor. In one embodiment, the circuit board is mounted in a first plane within the mobile communications device and the multi-band monopole antenna is mounted in a second plane within the mobile communications device.

DETAILED DESCRIPTION OF THE DRAWINGS

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and will fully convey the scope of the invention to those skilled in the art. The above summary of the invention is not intended to represent each embodiment or every aspect of the present invention.

Figure 1:
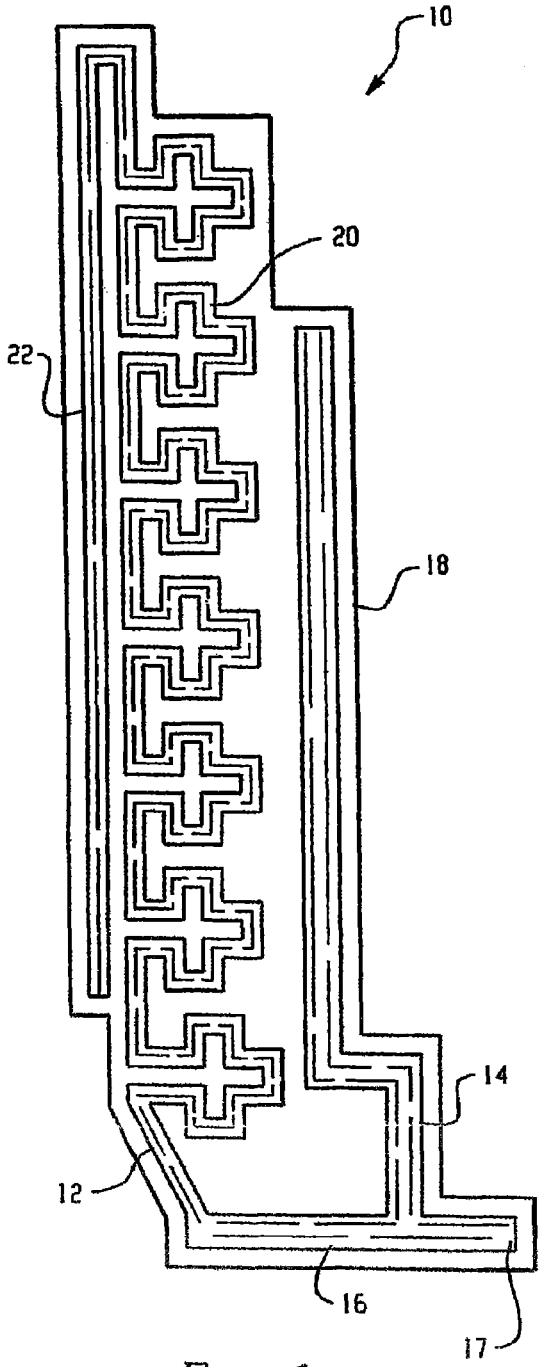
FIG. 1 is a top view of an exemplary multi-band monopole antenna for a mobile communications device.

Referring now to the drawing figures, FIG. 1 is a top view of an exemplary multi-band monopole antenna 10 for a mobile communications device. The multi-band monopole antenna 10 includes a first radiating arm 12 and a second radiating arm 14 that are both coupled to a feeding port 17 through a common conductor 16. The antenna 10 also includes a substrate material 18 on which the antenna structure 12, 14, 16 is fabricated, such as a dielectric substrate, a flex-film substrate, or some other type of suitable substrate material. The antenna structure 12, 14, 16 is preferably patterned from a conductive material, such as a metallic thick-film paste that is printed and cured on the substrate material 18, but may alternatively be fabricated using other known fabrication techniques.

The first radiating arm 12 includes a meandering section 20 and an extended section 22. The meandering section 20 is coupled to and extends away from the common conductor 16. The extended section 22 is contiguous with the meandering section 20 and extends from the end of the meandering section 20 back towards the common conductor 16. In the illustrated embodiment, the meandering section 20 of the first radiating arm 12 is formed into a geometric shape known as a space-filling curve, in order to reduce the overall size of the antenna 10. A space-filling curve is characterized by at least ten segments which are connected in such a way that each segment forms an angle with its adjacent segments, that is, no pair of adjacent segments define a larger straight segment. It should be understood, however, that the meandering section 20 may include other space-filling curves than that shown in FIG. 1, or may optionally be arranged in an alternative meandering geometry. FIGS. 2-6, for example, illustrate antenna structures having meandering sections formed from several alternative geometries. The use of shape-filling curves to form antenna structures is described in greater detail in the co-owned PCT Application WO 01/54225, entitled Space-Filling Miniature Antennas, which is hereby incorporated into the present application by reference.

The second radiating arm 14 includes three linear portions. As viewed in FIG. 1, the first linear portion extends in a vertical direction away from the common conductor 16. The second linear portion extends horizontally from the end of the first linear portion towards the first radiating arm. The third linear portion extends vertically from the end of the second linear portion in the same direction as the first linear portion and adjacent to the meandering section 20 of the first radiating arm 14.

Figure 10:
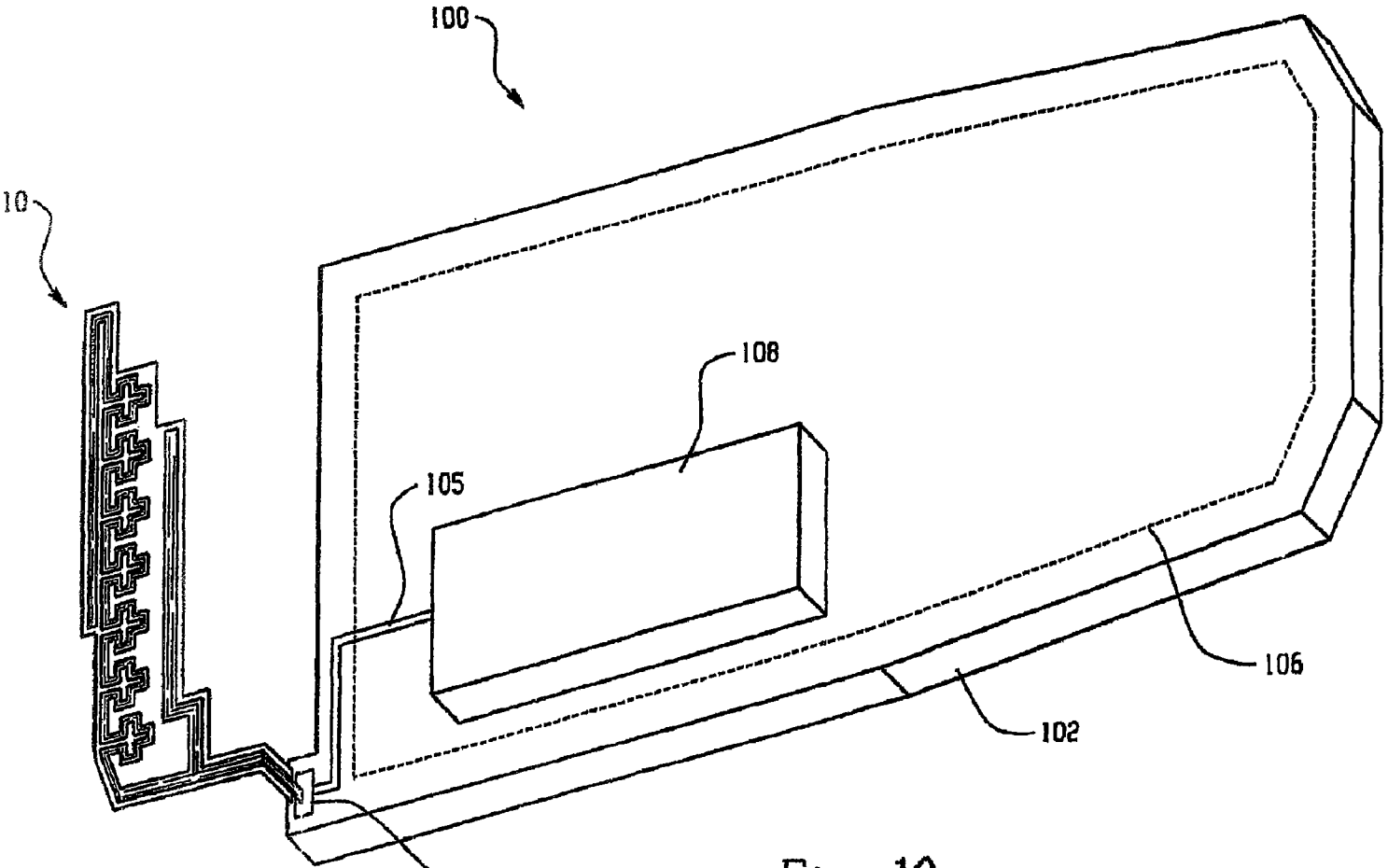
FIG. 10 is a top view of the exemplary multi-band monopole antenna of FIG. 1 coupled to a circuit board for a mobile communications device.

As noted above, the common conductor 16 of the antenna 10 couples the feeding port 17 to the first and second radiating arms 12, 14. The common conductor 16 extends horizontally (as viewed in FIG. 1) beyond the second radiating arm 14, and may be folded in a perpendicular direction (perpendicularly into the page), as shown in FIG. 10, in order to couple the feeding port 17 to communications circuitry in a mobile communications device.

Operationally, the first and second radiating arms 12, 14 are each tuned to a different frequency band, resulting in a dual-band antenna. The antenna 10 may be tuned to the desired dual-band operating frequencies of a mobile communications device by pre-selecting the total conductor length of each of the radiating arms 12, 14. For example, in the illustrated embodiment, the first radiating arm 12 may be tuned to operate in a lower frequency band or groups of bands, such as PDC (800 MHz), CDMA (800 MHz), GSM (850 MHz), GSM (900 MHz), GPS, or some other desired frequency band. Similarly, the second radiating arm 14 may be tuned to operate in a higher frequency band or group of bands, such as GPS, PDC (1500 MHz), GSM (1800 MHz), Korean PCS, CDMA/PCS (1900 MHz), CDMA2000/UMTS, IEEE 802.11 (2.4 GHz), or some other desired frequency band. It should be understood that, in some embodiments, the lower frequency band of the first radiating arm 12 may overlap the higher frequency band of the second radiating arm 14, resulting in a single broader band. It should also be understood that the multi-band antenna 10 may be expanded to include further frequency bands by adding additional radiating arms. For example, a third radiating arm could be added to the antenna 10 to form a tri-band antenna.

Figure 2:
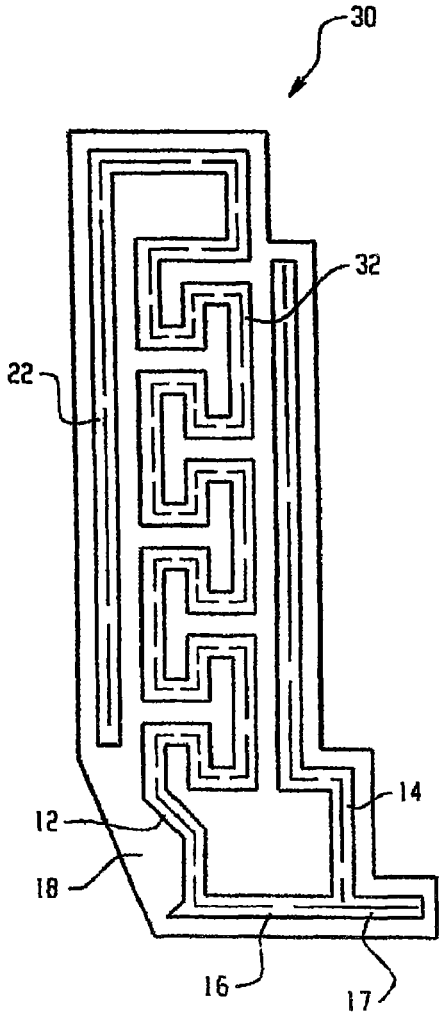
FIG. 2 is a top view of an exemplary multi-band monopole antenna including one alternative space-filling geometry.

FIG. 2 is a top view of an exemplary multi-band monopole antenna 30 including one alternative space-filling geometry. The antenna 30 show in FIG. 2 is similar to the multi-band antenna 10 shown in FIG. 1, except the meandering section 32 in the first radiating arm 12 includes a different space-filling curve than that shown in FIG. 1.

FIGS. 3-9 illustrate several alternative multi-band monopole antenna configurations 50, 70, 80, 90, 93, 95, 97. Similar to the antennas 10, 30 shown in FIGS. 1 and 2, the multi-band monopole antenna 50 illustrated in FIG. 3 includes a common conductor 52 coupled to a first radiating arm 54 and a second radiating arm 56. The common conductor 52 includes a feeding port 62 on a linear portion of the common conductor 52 that extends horizontally (as viewed in FIG. 3) away from the radiating arms 54, 56, and that may be folded in a perpendicular direction (perpendicularly into the page) in order to couple the feeding port 62 to communications circuitry in a mobile communications device.

The first radiating arm 54 includes a meandering section 58 and an extended section 60. The meandering section 58 is coupled to and extends away from the common conductor 52. The extended section 60 is contiguous with the meandering section 58 and extends from the end of the meandering section 58 in an arcing path back towards the common conductor 52.

The second radiating arm 56 includes three linear portions. As viewed in FIG. 3, the first linear portion extends diagonally away from the common conductor 52. The second linear portion extends horizontally from the end of the first linear portion towards the first radiating arm. The third linear portion extends vertically from the end of the second linear portion away from the common conductor 52 and adjacent to the meandering section 58 of the first radiating arm 54.

Figure 3:
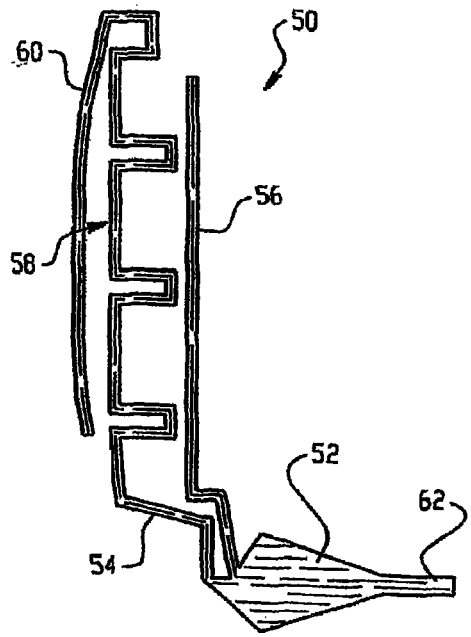
FIGS. 3-9 illustrate several alternative multi-band monopole antenna configurations.
Figure 4:
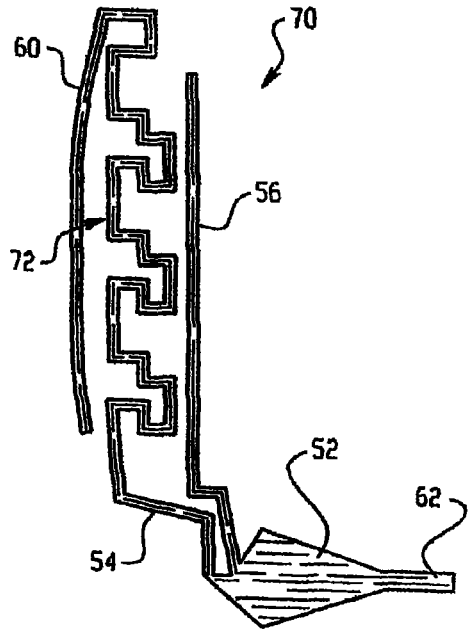
Figure 5:
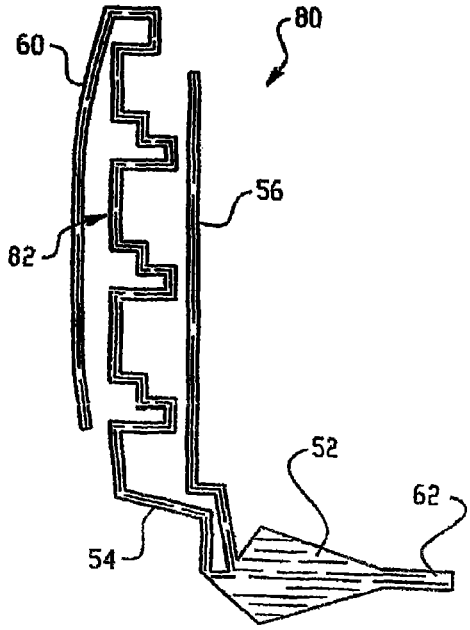
Figure 6:
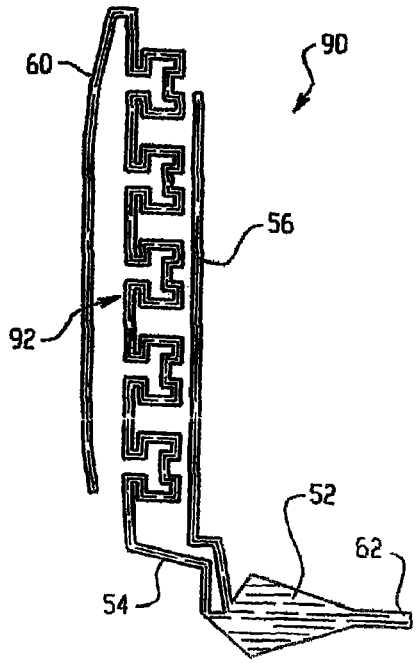

The multi-band monopole antennas 70, 80, 90 illustrated in FIGS. 4-6 are similar to the antenna 50 shown in FIG. 3, except each includes a differently-patterned meandering portion 72, 82, 92 in the first radiating arm 54. For example, the meandering portion 92 of the multi-band antenna 90 shown in FIG. 6 meets the definition of a space-filling curve, as described above. The meandering portions 58, 72, 82 illustrated in FIGS. 3-5, however, each include differently-shaped periodic curves that do not meet the requirements of a space-filling curve.

Figure 9:
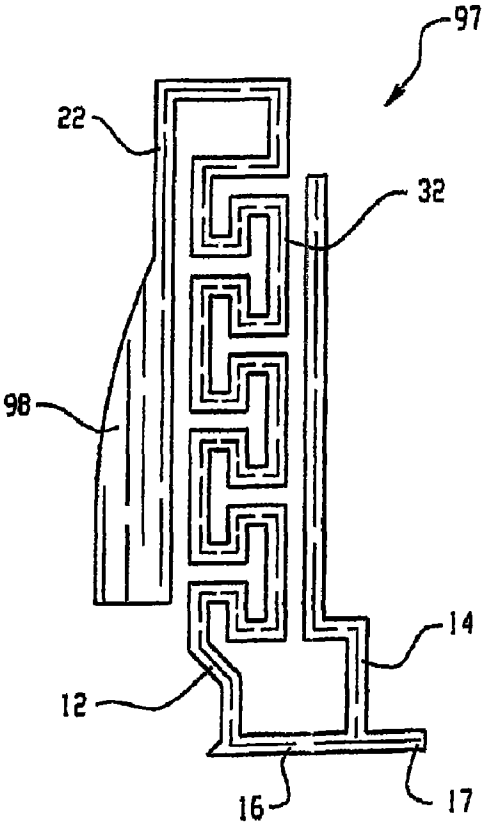
Figure 8:
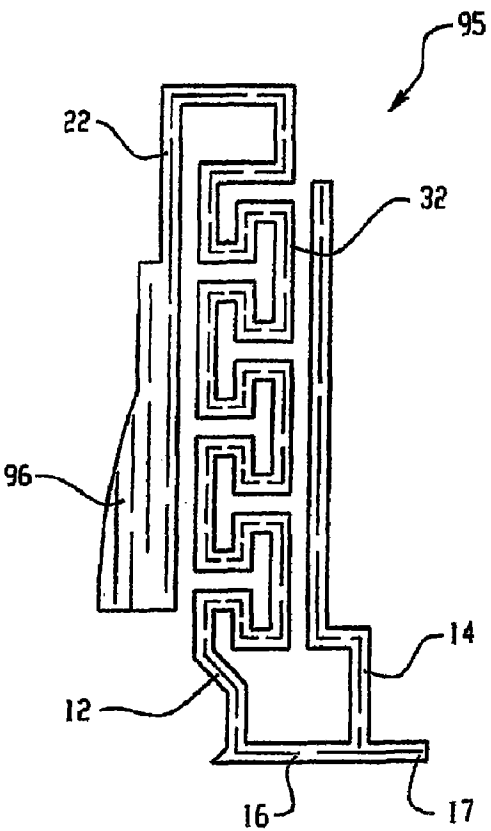
Figure 7:
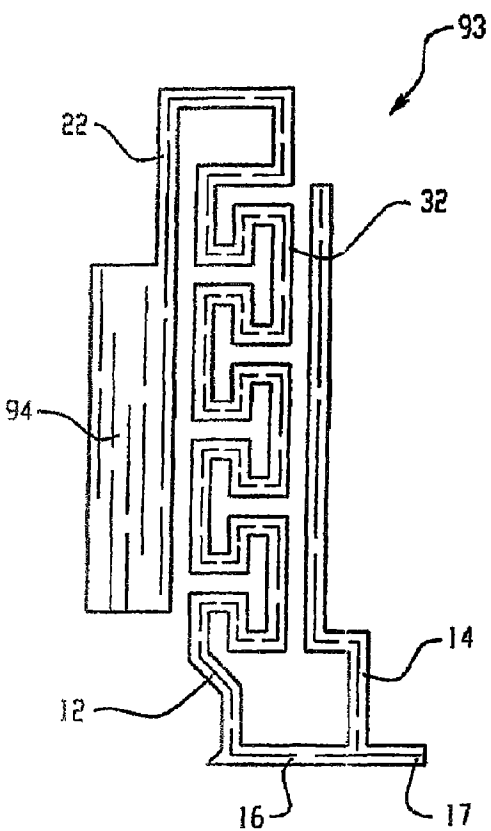

The multi-band monopole antennas 93, 95, 97 illustrated in FIGS. 7-9 are similar to the antenna 30 shown in FIG. 2, except in each of FIGS. 7-9 the expanded portion 22 of the first radiating arm 12 includes an additional area 94, 96, 98. In FIG. 7, the expanded portion 22 of the first radiating arm 12 includes a polygonal portion 94. In FIGS. 8 and 9, the expanded portion 22 of the first radiating arm 12 includes a portion 96, 98 with an arcuate longitudinal edge.

FIG. 10 is a top view 100 of the exemplary multi-band monopole antenna 10 of FIG. 1 coupled to the circuit board 102 of a mobile communications device. The circuit board 102 includes a feeding point 104 and a ground plane 106. The ground plane 106 may, for example, be located on one of the surfaces of the circuit board 102, or may be one layer of a multi-layer printed circuit board. The feeding point 104 may, for example, be a metallic bonding pad that is coupled to circuit traces 105 on one or more layers of the circuit board 102. Also illustrated, is communication circuitry 108 that is coupled to the feeding point 104. The communication circuitry 108 may, for example, be a multi-band transceiver circuit that is coupled to the feeding point 104 through circuit traces 105 on the circuit board.

In order to reduce electromagnetic interference from the ground plane 106, the antenna 10 is mounted within the mobile communications device such that the projection of the antenna footprint on the plane of the circuit board 102 does not intersect the metalization of the ground plane 106 by more than fifty percent. In the illustrated embodiment 100, the antenna 10 is mounted above the circuit board 102. That is, the circuit board 102 is mounted in a first plane and the antenna 10 is mounted in a second plane within the mobile communications device. In addition, the antenna 10 is laterally offset from an edge of the circuit board 102, such that, in this embodiment 100, the projection of the antenna footprint on the plane of the circuit board 102 does not intersect any of the metalization of the ground plane 106.

In order to further reduce electromagnetic interference from the ground plane 106, the feeding point 104 is located at a position on the circuit board 102 adjacent to a corner of the ground plane 106. The antenna 10 is preferably coupled to the feeding point 104 by folding a portion of the common conductor 16 perpendicularly towards the plane of the circuit board 102 and coupling the feeding port 17 of the antenna 10 to the feeding point 104 of the circuit board 102. The feeding port 17 of the antenna 10 may, for example, be coupled to the feeding point 104 using a commercially available connector, by bonding the feeding port 17 directly to the feeding point 104, or by some other suitable coupling means. In other embodiments, however, the feeding port 17 of the antenna 10 may be coupled to the feeding point 104 by some means other than folding the common conductor 16.

Figure 11:
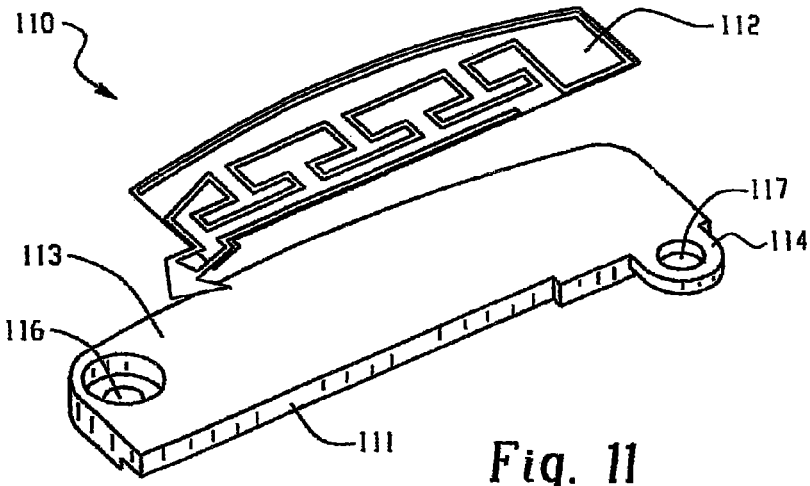
FIG. 11 shows an exemplary mounting structure for securing a multi-band monopole antenna within a mobile communications device.

FIG. 11 shows an exemplary mounting structure 111 for securing a multi-band monopole antenna 112 within a mobile communications device. The illustrated embodiment 110 employs a multi-band monopole antenna 112 having a meandering section similar to that shown in FIG. 2. It should be understood, however, that alternative multi-band monopole antenna configurations, as described in FIGS. 1-9, could also be used.

The mounting structure 111 includes a flat surface 113 and at least one protruding section 114. The antenna 112 is secured to the flat surface 113 of the mounting structure 111, preferably using an adhesive material. For example, the antenna 112 may be fabricated on a flex-film substrate having a peel-type adhesive on the surface opposite the antenna structure. Once the antenna 112 is secured to the mounting structure 111, the mounting structure 111 is positioned in a mobile communications device with the protruding section 114 extending over the circuit board. The mounting structure 111 and antenna 112 may then be secured to the circuit board and to the housing of the mobile communications device using one or more apertures 116, 117 within the mounting structure 111.

Figure 12:
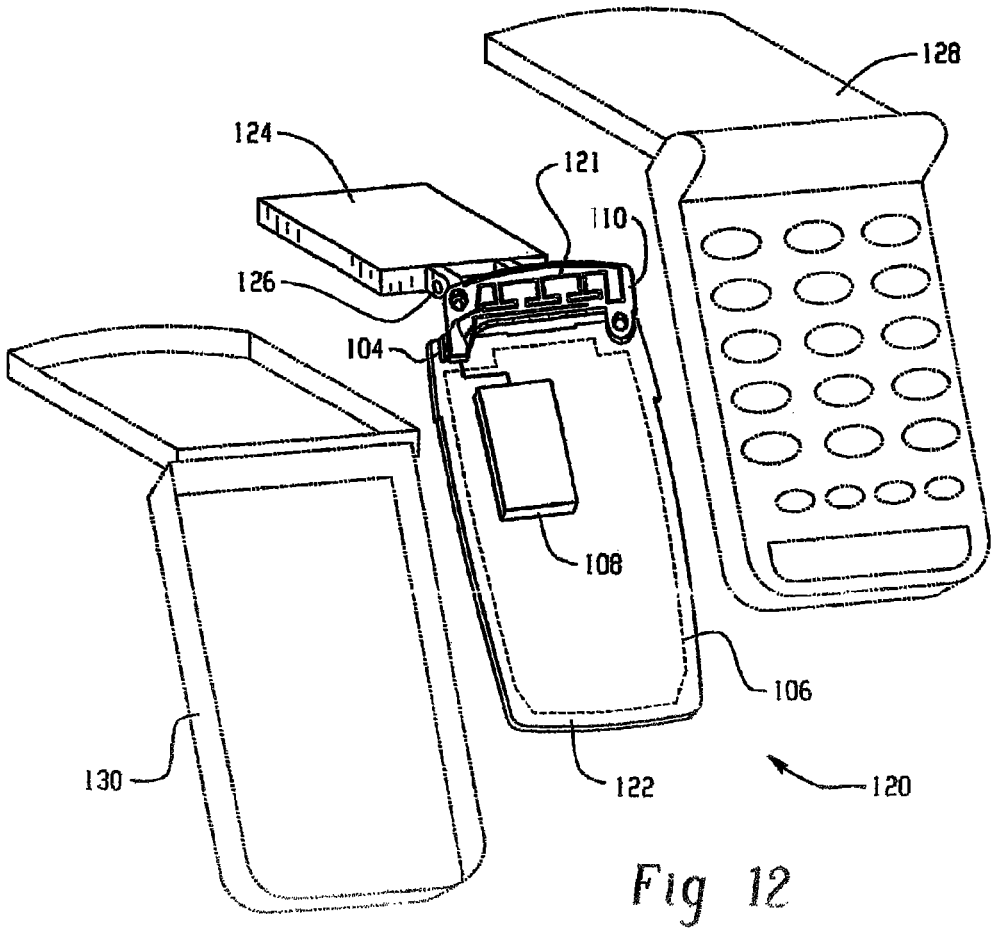
FIG. 12 is an exploded view of an exemplary clamshell-type cellular telephone having a multi-band monopole antenna.

FIG. 12 is an exploded view of an exemplary clamshell-type cellular telephone 120 having a multi-band monopole antenna 121. The cellular telephone 120 includes a lower circuit board 122, an upper circuit board 124, and the multi-band antenna 121 secured to a mounting structure 110. Also illustrated are an upper and a lower housing 128, 130 that join to enclose the circuit boards 122, 124 and antenna 121. The illustrated multi-band monopole antenna 121 is similar to the multi-band antenna 30 shown in FIG. 2. It should be understood, however, that alternative antenna configurations, as described above with reference to FIGS. 1-9, could also be used.

The lower circuit board 122 is similar to the circuit board 102 described above with reference to FIG. 10, and includes a ground plane 106, a feeding point 104, and communications circuitry 108. The multi-band antenna 121 is secured to a mounting structure 110 and coupled to the lower circuit board 122, as described above with reference to FIGS. 10 and 11. The lower circuit board 122 is then connected to the upper circuit board 124 with a hinge 126, enabling the upper and lower circuit boards 122, 124 to be folded together in a manner typical for clamshell-type cellular phones. In order to further reduce electromagnetic interference from the upper and lower circuit boards 122, 124, the multi-band antenna 121 is preferably mounted on the lower circuit board 122 adjacent to the hinge 126.

Figure 13:
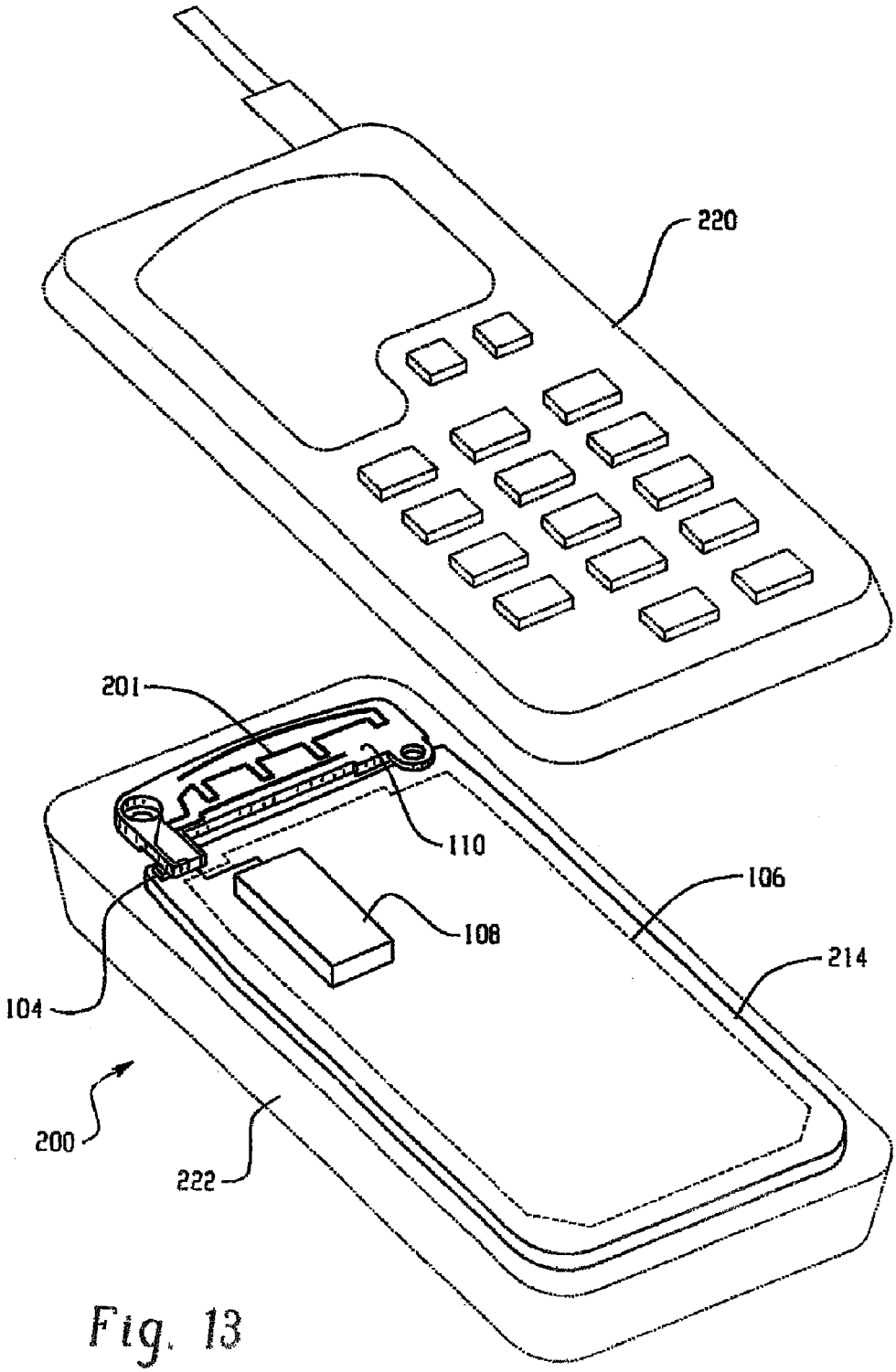
FIG. 13 is an exploded view of an exemplary candy-bar-style cellular telephone having a multi-band monopole antenna.

FIG. 13 is an exploded view of an exemplary candy-bar-type cellular telephone 200 having a multi-band monopole antenna 201. The cellular telephone 200 includes the multi-band monopole antenna 201 secured to a mounting structure 110, a circuit board 214, and an upper and lower housing 220, 222. The circuit board 214 is similar to the circuit board 102 described above with reference to FIG. 10, and includes a ground plane 106, a feeding point 104, and communications circuitry 108. The illustrated antenna 201 is similar to the multi-band monopole antenna shown in FIG. 3, however alternative antenna configurations, as described above with reference to FIGS. 1-9, could also be used.

The multi-band antenna 201 is secured to the mounting structure 110 and coupled to the circuit board 214 as described above with reference to FIGS. 10 and 11. The upper and lower housings 220, 222 are then joined to enclose the antenna 212 and circuit board 214.

Figure 14:
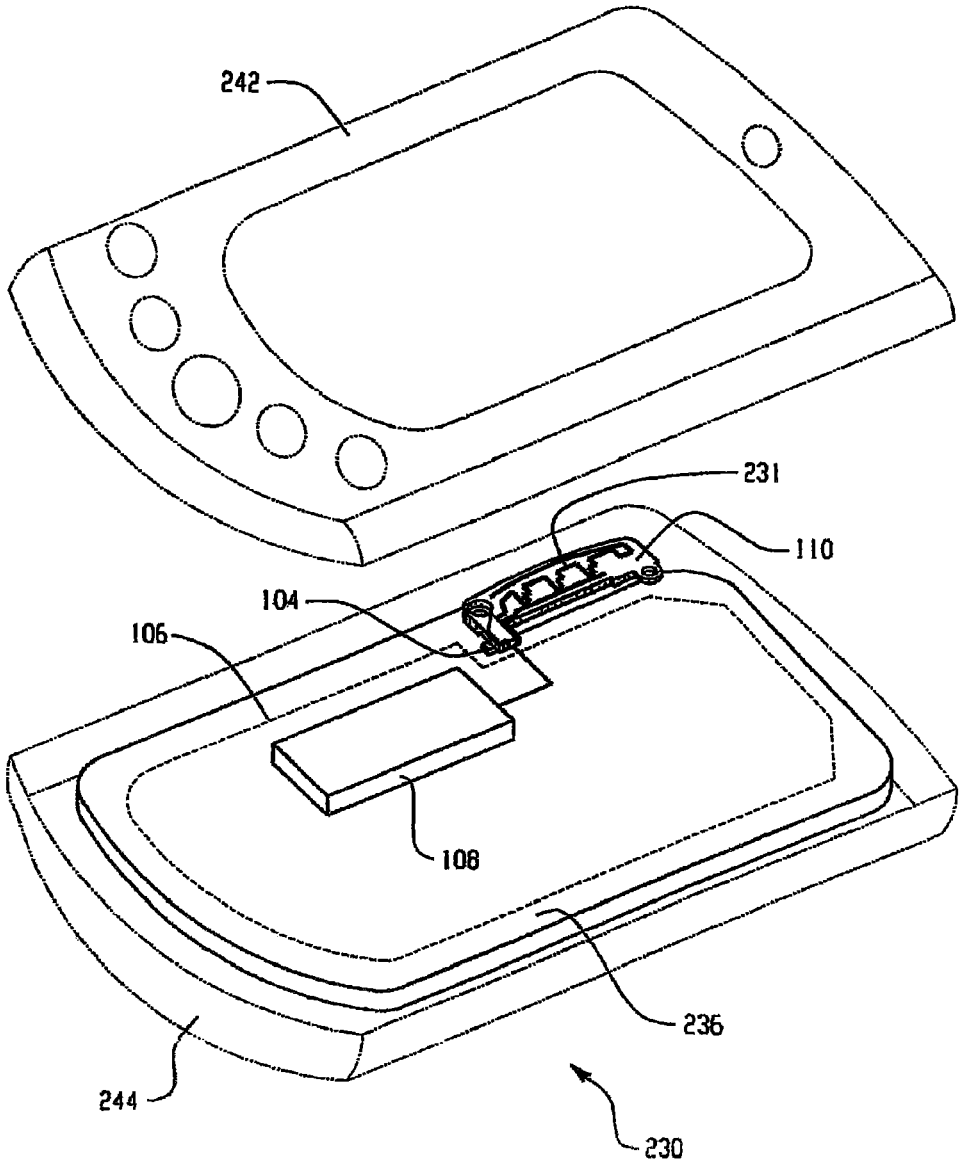
FIG. 14 is an exploded view of an exemplary personal digital assistant (PDA) having a multi-band monopole antenna.

FIG. 14 is an exploded view of an exemplary personal digital assistant (PDA) 230 having a multi-band monopole antenna 231. The PDA 230 includes the multi-band monopole antenna 231 secured to a mounting structure 110, a circuit board 236, and an upper and lower housing 242, 244. Although shaped differently, the PDA circuit board 236 is similar to the circuit board 102 described above with reference to FIG. 10, and includes a ground plane 106, a feeding point 104, and communications circuitry 108. The illustrated antenna 231 is similar to the multi-band monopole antenna shown in FIG. 5, however alternative antenna configurations, as described above with reference to FIGS. 1-9, could also be used.

The multi-band antenna 231 is secured to the mounting structure 110 and coupled to the circuit board 214 as described above with reference to FIGS. 10 and 11. In slight contrast to FIG. 10, however, the PDA circuit board 236 defines an L-shaped slot along an edge of the circuit board 236 into which the antenna 231 and mounting structure 110 are secured in order to conserve space within the PDA 230. The upper and lower housings 242, 244 are then joined together to enclose the antenna 231 and circuit board 236.

This written description uses examples to disclose the invention, including the best mode, and also to enable any person skilled in the art to make and use the invention. The patentable scope of the invention is defined by the claims, and may include other examples that occur to those skilled in the art.

What is claimed:

1. A clamshell-type multi-band mobile communications device comprising:

an upper circuit board;

a lower circuit board comprising a ground plane, a feeding point and communications circuitry;

a multi-band antenna connected to the communications circuitry and mounted on the lower circuit board, the multi-band antenna having a common conductor connected to the feeding point for coupling the multi-band antenna to the communications circuitry in the mobile communications device;

a first radiating arm coupled to the common conductor;

a second radiating arm coupled to the common conductor;

an upper housing and a lower housing hinged to one another, the upper housing enclosing the upper circuit board and the lower housing enclosing the lower circuit board and the multi-band antenna, the upper and lower housings enabling the upper and lower housings and the upper and lower circuit boards to be selectively folded together into a clamshell configuration or opened into a communications configuration;

wherein the lower circuit board is connected to the upper circuit board via a hinge enabling the upper and lower circuit boards to be folded together into a closed position;

wherein a projection of an antenna footprint on a plane of the lower circuit board does not intersect a metallization of the ground plane by more than fifty percent; and wherein the lower circuit board is mounted in a first plane within the mobile communications device and the multi-band monopole antenna is mounted in a second plane within the mobile communications device.

2. The mobile communications device of claim 1, wherein an edge of the multi-band antenna is laterally aligned with an edge of the lower circuit board.

3. The mobile communications device of claim 2, wherein the multi-band antenna is laterally offset from an edge of the ground plane.

4. The mobile communications device of claim 2, wherein a total length of the first radiating arm is greater than a total length of the second radiating arm.

5. The mobile communications device of claim 4, wherein the feeding point is located at a position on the lower circuit board corresponding to a corner of the ground plane.

6. The mobile communications device of claim 1, wherein a total length of the first radiating arm is greater than a total length of the second radiating arm.

7. The mobile communications device of claim 6, wherein an edge of the multi-band antenna is laterally aligned with an edge of the lower circuit board.

8. The mobile communications device of claim 6, wherein the multi-band antenna is laterally offset from an edge of the ground plane.

9. The mobile communications device of claim 8, wherein the feeding point is located at a position on the lower circuit board corresponding to a corner of the ground plane.

10. A clamshell-type multi-band mobile communications device comprising:

an upper circuit board;

a lower circuit board comprising a ground plane, a feeding point, and communications circuitry, the feeding point being coupled to the communications circuitry;

a multi-band antenna coupled to the communications circuitry and mounted on the lower circuit board, the multi-band antenna comprising:

a common conductor coupled to the feeding point;

a first radiating arm coupled to the common conductor;

a second radiating arm coupled to the common conductor;

an upper housing and a lower housing connected by a hinge, the upper housing enclosing the upper circuit board and the lower housing enclosing the lower circuit board, the hinge enabling the upper and lower housings and the upper and lower circuit boards to be folded together into a clamshell configuration and opened into a communications configuration;

wherein the hinge enables the lower circuit board to be electrically coupled to the upper circuit board;

wherein an edge of the multi-band antenna is laterally aligned with an edge of the lower circuit board; and wherein the lower circuit board is mounted in a first plane within the mobile communications device and the multi-band monopole antenna is mounted in a second plane within the mobile communications device.

11. The mobile communications device of claim 10, wherein a total length of the first radiating arm is greater than a total length of the second radiating arm.

12. The mobile communications device of claim 11, wherein the second radiating arm includes a linear section.

13. The mobile communication device of claim 12, wherein the second radiating arm includes a linear section adjacent to the first radiating arm.

14. The mobile communications device of claim 12, wherein the first radiating arm and the second radiating arm are substantially coplanar.

15. The mobile communications device of claim 10, wherein a projection of an antenna footprint on a plane of the lower circuit board does not intersect a metallization of the ground plane by more than fifty percent.

16. The mobile communications device of claim 15, wherein the multi-band antenna is secured to a mounting structure and wherein the mounting structure is secured to the lower circuit board or to the lower housing of the mobile communications device using one or more apertures.

17. The mobile communications device of claim 16, wherein the multi-band antenna is laterally offset from an edge of the ground plane.

18. The mobile communications device of claim 15, wherein the feeding point is located at a position on the lower circuit board corresponding to a corner of the ground plane.

* * * * *